US006575246B2

(12) United States Patent
Bixenman et al.

(10) Patent No.: US 6,575,246 B2
(45) Date of Patent: Jun. 10, 2003

(54) METHOD AND APPARATUS FOR GRAVEL PACKING WITH A PRESSURE MAINTENANCE TOOL

(75) Inventors: Patrick W. Bixenman, Houston, TX (US); Steven L. Anyan, Sugar Land, TX (US); Micah L. Schutz, Stafford, TX (US); James A. Pramann, II, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/929,867

(22) Filed: Aug. 14, 2001

(65) Prior Publication Data

US 2002/0036087 A1 Mar. 28, 2002

Related U.S. Application Data

(63) Continuation-in-part of application No. 09/839,683, filed on Apr. 20, 2001, now abandoned, which is a continuation of application No. 09/302,974, filed on Apr. 30, 1999, now Pat. No. 6,220,353.

(51) Int. Cl.[7] ..... E21B 43/04

(52) U.S. Cl. ..... 166/278; 166/51; 166/194; 166/374; 166/386; 166/387

(58) Field of Search ..... 166/51, 191, 194, 166/276, 278, 374, 377, 386, 387

(56) References Cited

U.S. PATENT DOCUMENTS

| | | | | |
|---|---|---|---|---|
| 3,602,307 A | * | 8/1971 | Price et al. | |
| 4,042,033 A | | 8/1977 | Holland et al. | 166/310 |
| 4,253,522 A | | 3/1981 | Setterberg, Jr. | 166/278 |
| 4,273,190 A | * | 6/1981 | Baker et al. | |
| 4,470,465 A | | 9/1984 | Zimmerman et al. | 166/332 |
| 4,540,051 A | | 9/1985 | Schmuck et al. | 166/278 |
| 4,566,538 A | | 1/1986 | Peterson | 166/278 |
| 4,606,408 A | | 8/1986 | Zunkel et al. | 166/278 |
| 4,627,488 A | | 12/1986 | Szarka | 166/51 |
| 4,633,943 A | | 1/1987 | Zunkel | 166/51 |
| 4,635,716 A | | 1/1987 | Zunkel | 166/51 |
| 4,638,859 A | | 1/1987 | Zunkel et al. | 166/51 |
| 4,862,957 A | | 9/1989 | Scranton | 166/51 |
| 4,940,093 A | | 7/1990 | Hilsman, III | 166/332 |
| 5,069,280 A | | 12/1991 | McKee et al. | 166/278 |
| 5,174,379 A | | 12/1992 | Whiteley et al. | 166/278 |
| 5,332,038 A | | 7/1994 | Tapp et al. | 166/278 |
| 5,366,009 A | | 11/1994 | Cornette et al. | 166/51 |
| 5,597,040 A | | 1/1997 | Stout et al. | 166/51 |
| 5,641,023 A | | 6/1997 | Ross et al. | 166/386 |
| 5,845,712 A | | 12/1998 | Griffith, Jr. | 166/278 |
| 6,230,801 B1 | | 5/2001 | Hill, Jr. et al. | 166/278 |

FOREIGN PATENT DOCUMENTS

| | | |
|---|---|---|
| EP | 0 903 462 A2 | 3/1999 |

* cited by examiner

*Primary Examiner*—Roger Schoeppel
(74) *Attorney, Agent, or Firm*—Trop, Pruner & Hu, P.C.; Jeffrey E. Griffin; Brigitte L. Jeffery

(57) ABSTRACT

A method and apparatus for performing a gravel pack operation includes a bypass mechanism (e.g., a bypass valve) that is actuatable between plural positions. The bypass mechanism is part of a tool assembly, with the bypass mechanism providing different flow paths through the tool assembly corresponding to the plural positions of the bypass mechanism. For example, if the bypass mechanism is in a first position, an elevated pressure is communicated from an annular region outside a tool string to a target wellbore section. On the other hand, if the bypass mechanism is in the second position, the elevated pressure is communicated from inside the tool string to the target wellbore section. In either position, an overbalance condition is maintained in the target wellbore section so that swabbing effects are reduced or eliminated due to movement of the tool assembly during a gravel pack operation.

43 Claims, 50 Drawing Sheets

METHOD AND APPARATUS FOR GRAVEL PACKING WITH A PRESSURE MAINTENANCE TOOL

CROSS REFERENCE TO RELATED APPLICATIONS

This is a continuation-in-part of U.S. Ser. No. 09/839,683, filed Apr. 20, 2001, now abandoned which is a continuation of U.S. Ser. No. 09/302,974, filed Apr. 30, 1999, U.S. Pat. No. 6,220,353.

TECHNICAL FIELD

The invention relates generally to methods and apparatus related to gravel packing with a tool that maintains a desired pressure in a target wellbore section.

BACKGROUND

Techniques are well known in the oil and gas industry for controlling sand migration into wells penetrating unconsolidated formations by gravel packing the wells. Sand migration and collapse of unconsolidated formations can result in decreased flow and production, increased erosion of well components, and production of well sand which is a hazardous waste requiring specialized handling and disposal. Such gravel packing typically involves depositing a quantity, or "pack," of gravel around the exterior of a perforated pipe and screen. The gravel pack then presents a barrier to the migration of the sand while still allowing fluid to flow from the formation. In placing the gravel pack, the gravel is carried into the well and into the formation in the form of a slurry, with much of the carrier fluid or workover fluid being returned to the surface, leaving the gravel in the desired location.

An increasingly popular technique to complete wells with sand control problems is an open hole gravel pack. However, to successfully complete an open hole gravel pack, it is often necessary to maintain good mudcake integrity in the open hole interval. This can be accomplished by maintaining an overbalance condition in the wellbore with respect to the reservoir adjacent the wellbore. An overbalance condition exists when the pressure within the wellbore is higher than the reservoir pressure.

However, many conventional gravel pack service tools used for performing gravel pack in an open hole section of a wellbore tend to swab the open hole section as the service tools are moved to various positions during a gravel pack operation. Swabbing occurs as a service tool is pulled up while various seals of the service tool remain engaged (such as seals within seal bores and packer seals against the inner surface of the wellbore). The swabbing effect causes pressure in the open hole section of the wellbore below the seals to drop. If the drop in pressure is high enough, then the pressure in the open hole section may drop below the reservoir pressure, thereby causing the overbalance condition to be removed. When the overbalance condition no longer exists in the open hole section of the wellbore, reservoir fluids can start flowing into the wellbore, which may cause damage to the mudcake. Once the mudcake is damaged, fluid loss from the wellbore to the reservoir may occur when the pressure in the open hole section is again restored to the overbalance condition. In some cases, such fluid loss can be great enough to prevent successful gravel packing of the interval.

A need thus exists for an improved method and apparatus of gravel packing an open hole section of a wellbore.

SUMMARY

A method for use in a wellbore includes performing a gravel pack operation with a tool assembly in a section of the wellbore and providing a bypass mechanism in the tool assembly. The bypass mechanism is actuated using a remote signal, and communication of an elevated pressure is maintained through the bypass mechanism to the wellbore section to provide an overbalance condition in the wellbore section.

Other or alternative features will become apparent from the following description, from the claims, and from the drawings.

DETAILED DESCRIPTION

In the following description, numerous details are set forth to provide an understanding of the present invention. However, it is to be understood by those skilled in the art that the present invention may be practiced without these details and that numerous variations or modifications from the described embodiments may be possible.

As used here, the terms "up" and "down"; "upper" and "lower"; "upwardly" and downwardly"; "upstream" and "downstream"; "above" and "below"; and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

Figure 1:
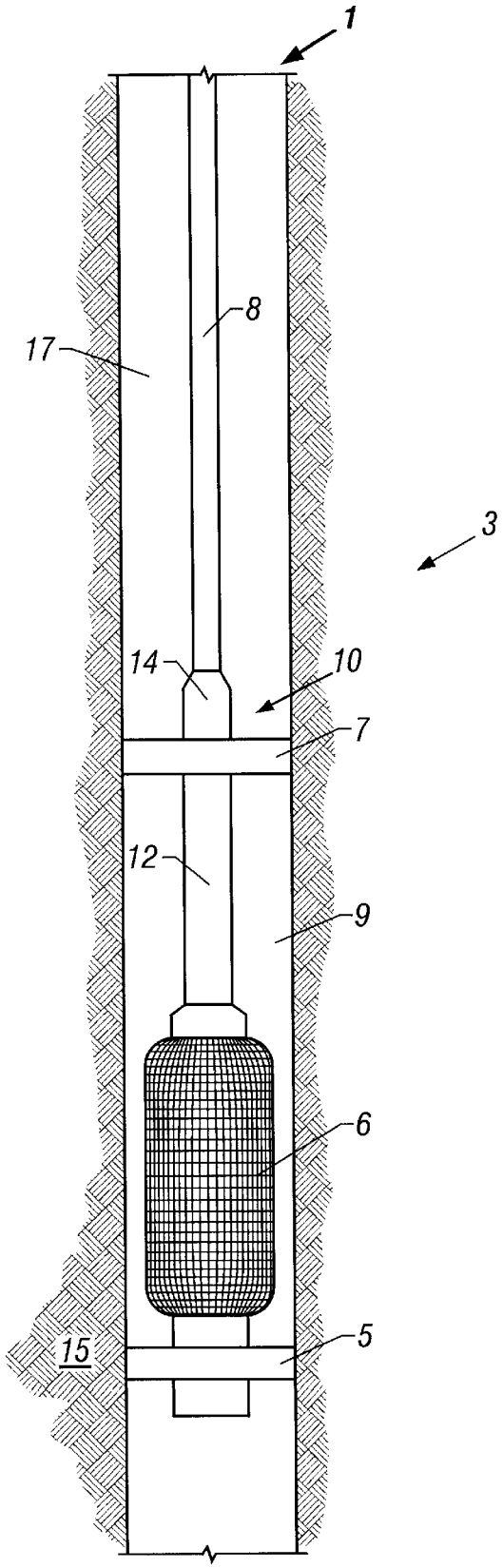
FIG. 1 illustrates an example service string that includes a tool assembly according to some embodiments of the invention.

FIG. 1 illustrates an example service string 3 positioned in a wellbore 1. The service string 3 includes a bottom packer 5, a sand screen 6, and a gravel pack tool assembly 10 that includes a tool assembly packer 7, a gravel pack tool assembly housing 12, and a service tool 14 mounted in the housing 12. The service string 3 is supported by a tubing string 8 extending to the well surface. The service string 3 is lowered to align the packers 7 and 5 above and below a target open hole section of the wellbore where gravel packing is desired. The target open hole section is adjacent a reservoir 15 in the surrounding formation. The packers are set to isolate the production zone in the reservoir 15 and to define an annular area 9 between the service string 3 and the inner wall of the wellbore 1. The gravel pack is then performed and the zone produced.

A gravel pack operation in an open hole section of the wellbore includes at least two operations (among others): the circulate operation and the reverse operation. A circulate operation involves pumping gravel slurry into the annular area 9 between the sand screen 6 and the inner wall of the wellbore. In the circulate position, a return flow path is open to allow return fluid to flow back to the well surface. The sand screen 6 holds the gravel material of the gravel slurry in the annular area 9 but allows fluids to pass therethrough. Once the deposited gravel material reaches the top of the sand screen 6, the pressure will rise rapidly indicating screen out and a full annular region 9.

When the annular region 9 is packed, the service string 3 may be pulled from the wellbore 1. However, to prevent dropping of any gravel material remaining in the service string 3 and the tubing 8 into the well when pulling the string from the well, the gravel in the tubing 8 and service string 3 is reverse circulated to the surface before the string is removed. This procedure of reverse circulating the remaining gravel from the well is referred to as the reverse operation. In general, a flow of fluid down the annular region 17 above the packer 7 is reverse circulated through the tubing 8 to pump the gravel remaining in the tubing string 8 and service string 3 to the surface.

Generally, because bridging may occur when depositing the gravel in the well, which causes gaps to be created in the gravel pack, the circulate operation may be performed more than once for each gravel pack operation. This is referred to as "restressing the pack." The reverse operation may be performed before restressing the packing.

The gravel pack tool assembly 10 in the service string 3 enables gravel pack operations of the open hole section of the wellbore 1 by providing the circulate position and the reverse position. Also, in accordance with some embodiments of the invention, the gravel pack tool assembly 10 communicates hydrostatic pressure (or some other elevated pressure) above the packer 7 to the target open hole section of the wellbore 1 throughout different phases of the gravel pack operation to maintain an overbalance condition in the open hole section. Thus, if the service string 3 needs to be moved for any reason during the gravel pack operation, a swabbing effect in the open hole section is prevented or reduced. By maintaining an overbalance condition in the open hole section (by communicating the hydrostatic or other elevated pressure to the target open hole section), flow of fluids from the reservoir into the open hole section of the wellbore 1 is prevented so that mudcake damage can be prevented or reduced.

Figure 2A:
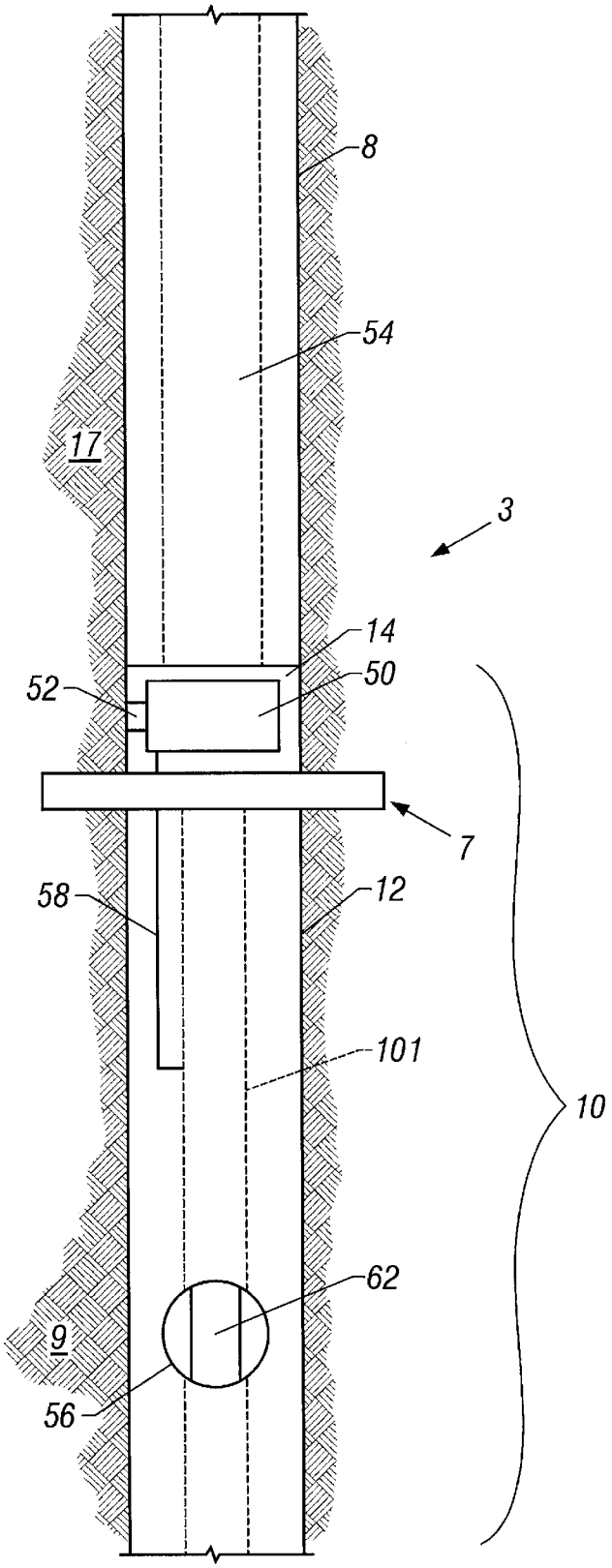
FIGS. 2A–2B illustrate two embodiments of the tool assembly of FIG. 1.

FIG. 2A is a schematic diagram of components of the gravel pack tool assembly 10 that enables the maintenance of an elevated pressure (e.g., hydrostatic pressure) to the target open hole section during various phases of a gravel pack operation. The gravel pack tool assembly 10 includes a bypass mechanism 50 (such as a bypass valve) that selectively communicates through a radial port 52 to the annular region 17 outside the gravel pack tool assembly 10 and above the packer 7. The bypass valve 50 is also selectively communicates with the inner bore 54 of the tubing 8.

A fluid communications conduit 58 is provided from the bypass valve 50 to an inner bore 101 of the service tool 14 that is connected below the packer 7. A flow control element 56 (such as a valve) is arranged to control fluid flow through the bore 101 of the service tool 14. In one embodiment, the valve 56 is a ball valve that has a flow path 62 that is aligned with the bore 101 when the valve 56 is in the open position. In the closed position, the flow path 62 of the ball valve 56 is generally perpendicular to the bore 101 of the service tool 14 to prevent fluid flow. Alternatively, instead of a ball valve, the valve 56 can be a flapper valve or any other type of valve to control fluid flow through the service tool bore 101.

In one embodiment, the bypass mechanism 50, conduit 52, and valve 56 are part of the service tool 14. Alternatively, the components can be part of different portions of the tool assembly 10.

The bypass valve 50 has at least two positions, which are referred to as a first position and a second position. In the first position, the bypass valve 50 enables fluid flow from the annular region 17 through the port 52 to the conduit 58. Thus, in the first position, the bypass valve 50 enables communication of pressure in the annular region 17 (which is at hydrostatic pressure or at some other elevated pressure) to the inner bore 101, which is in turn communicated by the open valve 56 to the target open hole section of the wellbore 1. This enables maintenance of an overbalance condition in the target open hole section.

To enable a pressure test of the packer 7 during the testing phase of the gravel pack operation, the bypass valve 50 is actuated to its second position, where fluid communication through the port 52 is shut off. This enables the pressure in the annular region 17 to be increased for testing the packer 7. In its second position, the bypass valve 50 communicates pressure in the bore 54 of the tubing 8 to the conduit 58. Thus, the pressure in the bore 54 (which is at hydrostatic pressure or some other elevated pressure) is communicated through the bypass valve 50, the conduit 58, and the bore 101 to the target open hole section to maintain the overbalance condition.

More generally, if the bypass valve 50 is in the first position, then fluid communication between the annular region 17 and the target wellbore section through a first flow path in the tool assembly 10 is enabled. On the other hand, if the bypass valve 50 is in a second position, then fluid communication between the inside of the tubing string 8 and the target wellbore section through a second flow path in the tool assembly 10 is enabled. In other embodiments, the bypass valve 50 has more than two positions.

The bypass valve 50 is a remotely-operable valve that can be actuated between different positions by a remote signal from the well surface (e.g., an applied hydraulic pressure, an electrical signal, an acoustic signal, an electromagnetic signal, a pressure pulse signal, an optical signal, and so forth). The bypass valve 50 can be remotely operated without user manipulation of the service tool 14 that includes the bypass valve 50.

Figure 2B:
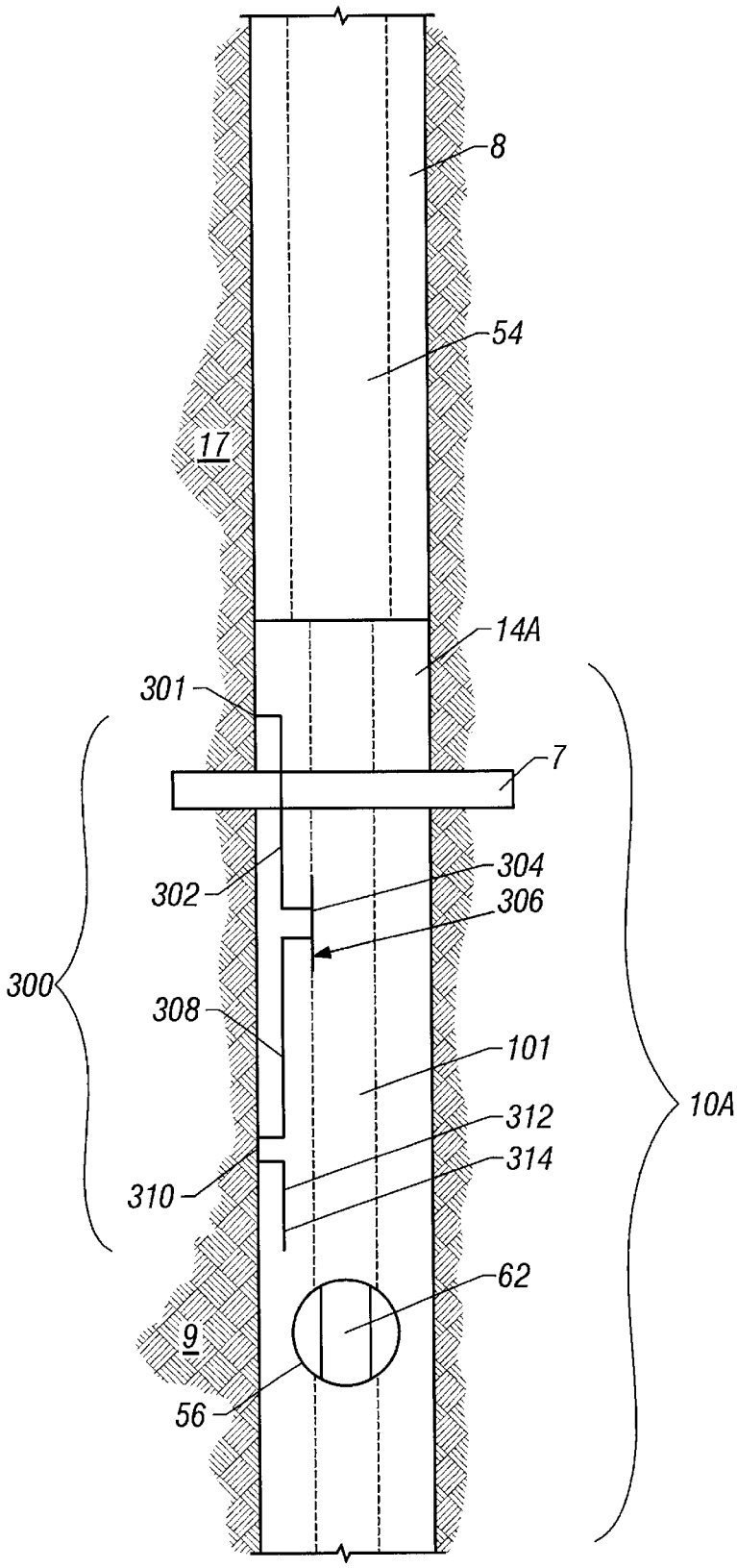

FIG. 2B shows a different embodiment of a gravel pack tool assembly, referred to as tool assembly 10A. As in the tool assembly 10 of FIG. 2A, the tool assembly 10A also includes a packer 7 and a ball valve 56. However, the bypass mechanism (referred to as 300) of the tool assembly 10A is different from that in the tool assembly 10 of FIG. 2A. The bypass mechanism 300 selectively communicates with the annular region 17 through a radial port 301. The bypass mechanism 300 includes a first conduit 302 that is in communication with the port 301. The first conduit 302 communicates with a second conduit 308 through a flow control element 304, which in one embodiment is a sleeve having a flow path therethrough to enable communication between the flow conduits 302 and 308 when the sleeve 304 is in a first position. However, if the sleeve 304 is moved to a second position, a sealing element 306 blocks communication of fluid flow between the conduits 302 and 308.

The lower end of the flow conduit 308 communicates with an outlet port 310. Thus, when the flow control element 304 is in its open position, fluid communication between the annular region 17 (above the packer 7) and the annular region 9 (below the packer 7) is enabled. The elevated pressure in the annular region 17 (e.g., hydrostatic pressure) is communicated through the bypass mechanism 300 to the annular region 9 to maintain an overbalance condition in the target open hole section. However, when the bypass mechanism 300 is set in a second position such that this sealing element 306 of the flow control element 304 blocks fluid flow between the conduits 302 and 308, another flow path is defined to communicate elevated pressure in the inner bore 54 of the tubing string 8 to the annular region 9. When the flow control element 304 is moved upwardly, a crossover element 312 is also moved upwardly such that a crossover port 314 is aligned with the outlet port 310. In this position, fluid communication is enabled between the inner bore 54 of the tubing string 8 and the annular region through the crossover port 314 and the outlet port 310. The second position of the bypass mechanism 300 is provided to enable the annular region to be isolated to pressure test the packer 7.

Thus, more generally, a tool assembly is provided to enable gravel packing of an open hole section of a wellbore while maintaining a desired pressure in the target open hole section so that an overbalance condition is provided with respect to a reservoir adjacent the target open hole section. The tool assembly includes a bypass mechanism (either the bypass valve 50 of FIG. 2A or the bypass mechanism 300 of FIG. 2B) to selectively communicate elevated pressure in an annular region or in a tool string with the target open hole section.

FIGS. 3A–3F, 4A–4F, 5A–5F, 6A–6F, 7A–7H, 8A–8G, and 9A–9H illustrate various different positions of the components of the gravel pack tool assembly 10 illustrated in FIG. 2A. FIGS. 10–15 illustrate various different positions of the bypass valve 50.

Figure 3A:
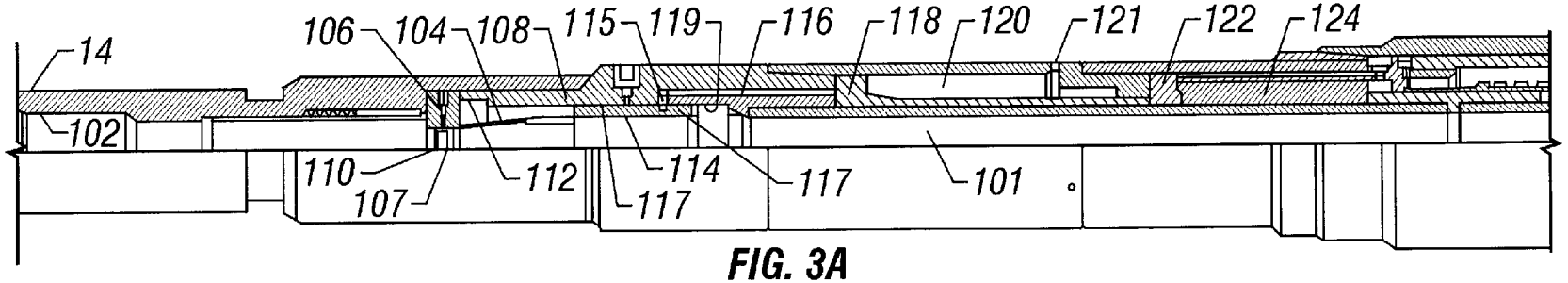
FIGS. 3A–3F, 4A–4F, 5A–5F, 6A–6F, 7A–7H, 8A–8G, and 9A–9H are longitudinal sectional views of the tool assembly of FIG. 2A in different positions.
Figure 3B:
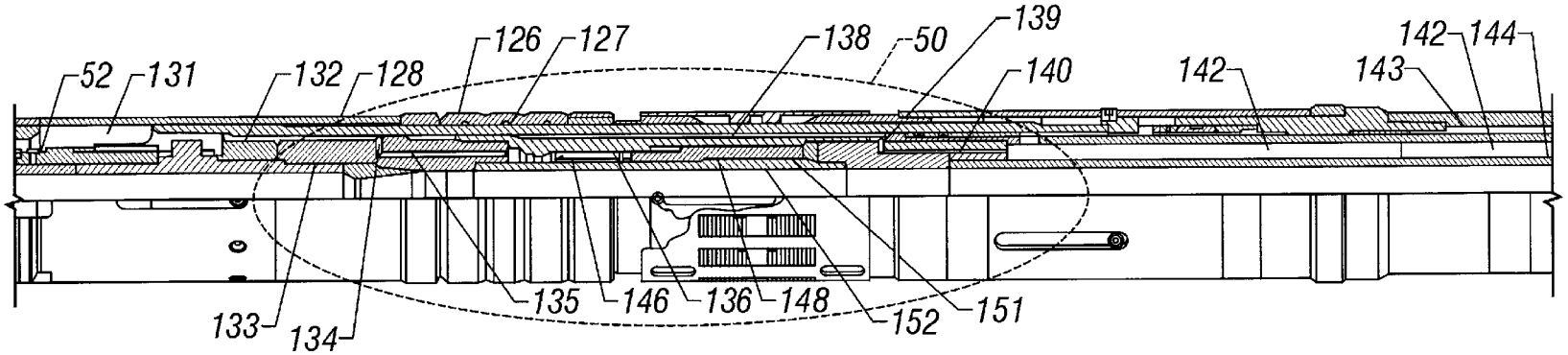
Figure 4B:
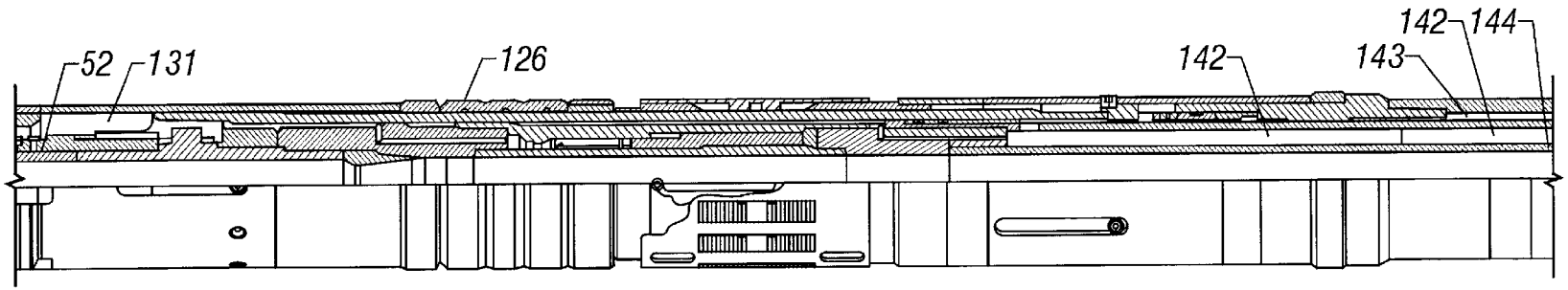
Figure 3C:
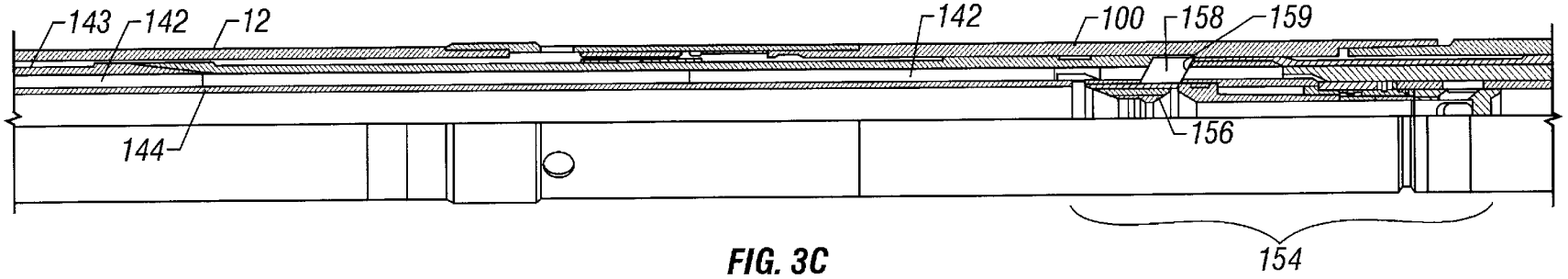

FIGS. 3A–3F show the tool assembly 10 in the run-in position as the service string 3 (FIG. 1) is run into the wellbore. The gravel pack tool assembly 10 includes the service tool 14, the packer 7, and the housing 12. Although referred to in the singular, the housing 12 may actually be implemented with multiple housing segments that are connected to each other. One of the segments of the housing 12 is a polished bore receptacle 100 to receive the service tool 14 (FIG. 3C).

As shown in FIG. 3A, the upper end of the service tool 14 includes a connection member 102 for connecting the service tool 14 to the tubing string 8. In FIG. 3A, a collet 104 is shown in a squeezed position. An upper portion 107 of the collet 104 is attached to a housing member 108 by a shear element 106 (e.g., a shear pin, a shear screw, etc.). Although referred to in the singular, a "shear element" is intended to cover plural shear elements.

A ball seat 110 is defined by the upper portion 107 of the collet 104, which ball seat 110 is adapted to receive a ball (not shown in FIG. 3A) dropped from the well surface through the tubing string 8. The housing member 108 provides an inner profile 112 to receive the upper portion 107 of the collet 104 once the collet portion 107 collapses after it has been pushed downwardly by increased pressure against the ball received in the ball seat 110 (discussed below).

The lower portion of the collet 104 is connected to a sleeve 114 that is slidably arranged inside the housing member 108. In the position shown in FIG. 3A, the sleeve 114 covers a radial port 115 leading to a longitudinal conduit 116 in the housing member 108. Seals 117 are provided on the sleeve 114 to seal around the port 115 when the sleeve 114 is in the illustrated position of FIG. 3A.

The conduit 116 leads to one side of a first piston 118. The other side of the first piston 118 communicates with a chamber 120 that communicates with the annular region 17 through a port 121. Thus, the chamber 120 is at the pressure of the annular region 17 (e.g., hydrostatic pressure).

A longitudinal element of the first piston 118 extends downwardly to contact an upper end of a second piston 122. The other side of the second piston 122 communicates with a chamber 124, which is also at a pressure equal to the pressure in the annular region 17 outside the tool assembly 10.

The combination of the first and second pistons 118 and 122 form a packer setting piston for setting the packer 7. The packer 7 includes a sealing element 126 (arranged on the outer surface of a packer housing 127) that is compressible by a setting sleeve 128. The setting sleeve 128 is actuated downwardly in response to the setting piston (including pistons 118 and 122) being actuated downwardly by applied pressure through the conduit 116. However, in the position of FIG. 3A, the conduit 116 is isolated from pressure inside the bore 101 of the service tool 14.

As shown in FIG. 3B, the service tool 14 includes the bypass valve 50, which is arranged inside the packer 7. The radial port 52 in the packer 7 provides communication between the annular region 17 outside the tool assembly 10 and a chamber 131 within the packer 7. The chamber 131 leads to a conduit 132 that is defined between the outer surface of a housing 133 of the bypass valve 50 and the packer housing 127. The conduit 132 leads to a port 134 in the bypass valve housing 133. The port 134 communicates with a conduit 135 defined inside the bypass valve housing 133 The conduit 135 extends downwardly to a lower radial port 136 in the bypass valve housing 133. The radial port 136 leads to another conduit 138 between the bypass valve housing 133 and the packer housing 127.

The conduit 138 extends downwardly to communicate with a lower conduit 140 through another radial port 139 in the bypass valve housing 133. The lower conduit 140 leads to a channel 142 defined between the housing 143 and an inner sleeve 144 of the service tool 14. Collectively, in one embodiment, the conduit 58 of FIG. 2A includes the conduits and ports 132, 134, 135, 136, 138, 139, 140, and 142. Note that the conduit 58 can have other arrangements in other embodiments.

As also shown in FIG. 3B (enlarged view in FIG. 10), the bypass valve 50 includes a bypass valve locking collet 146 that is moveable upwardly by a bypass valve actuating piston 148. The collet 146 is connected to the piston 148 by a shear element 147. The piston 148 is initially connected to the bypass valve housing 133 by a shear element 149. The bypass valve 50 also includes a ratchet ring 150 for receiving a lower portion of the piston 148. In the position shown in FIG. 3B and FIG. 10, the piston 148 is not engaged in the ratchet ring 150.

Pressure in the inner bore 101 of the service tool 14 is communicated through a radial port 151 of an inner sleeve 152 of the bypass valve 50 to one side of the piston 148. The other side of the piston 148 communicates with a chamber 145, which is at the pressure of the annular region 17 in the position shown in FIGS. 3B and 10. Movement of the piston 148 in response to pressure communicated through the port 151 is opposed by the shear element 149.

Figure 3D:
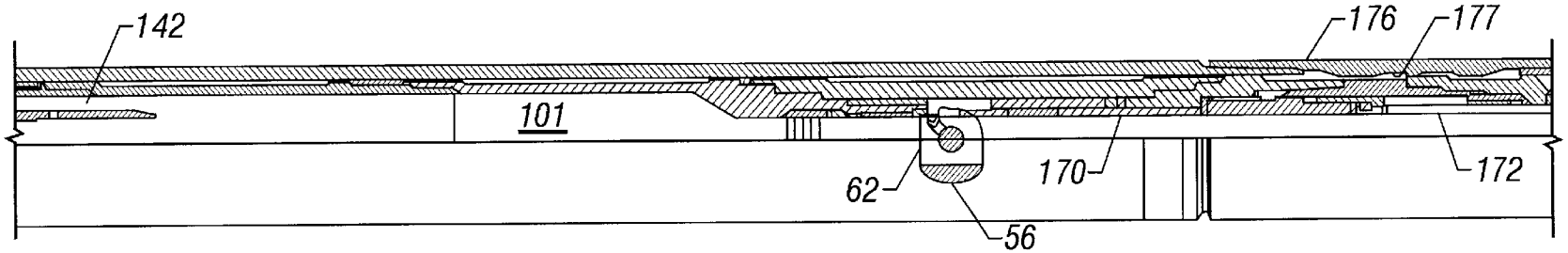

As shown in FIGS. 3C–3D, the channel 142 extends downwardly through a cross-over mechanism 154 and exits to the inner bore 101 of the service tool 14. The cross-over mechanism 154 includes one or more cross-over ports 158 that are defined within a cross-over port body 159. In the position shown in FIG. 3C, the cross-over port(s) 158 are sealably covered by a ball seat 156. The ball seat 156 is configured to receive a ball (not shown in FIG. 3C but shown in FIG. 4C) dropped from the well surface. This is the same ball that is capable of being received by the ball seat 110 in FIG. 3A.

In FIG. 3D, the ball valve 56 arranged in the service tool 14 is in the open position so that the flow path 62 of the ball valve 56 is in alignment with the inner bore 101 of the service tool 14. The ball valve 62 is actuated by longitudinal movement of an operator member 170 operably coupled to the ball valve 56. The operator member 170 is coupled to a J-slot mandrel 172 (FIGS. 3D–3E), which is rotatable about a longitudinal axis of the service tool 14 with respect to the operator member 170. An outer surface of the J-slot mandrel 172 defines a J-slot pattern. A pin 174 is engaged in the J-slot pattern to cause rotational movement and longitudinal movement of the J-slot mandrel 172. Longitudinal translation of the mandrel 172 causes a corresponding longitudinal translation of the operator member 170.

Figure 3E:
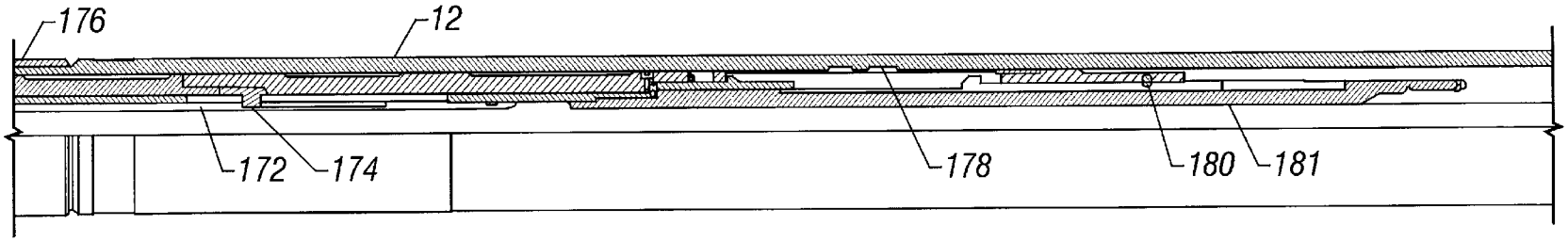
Figure 4E:
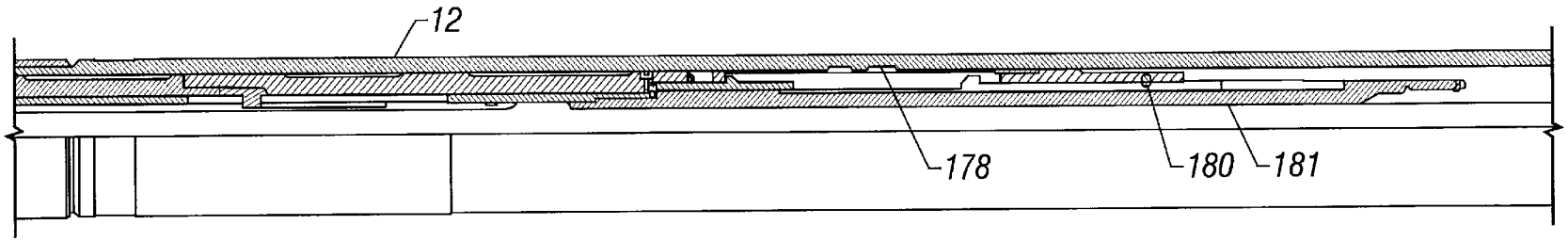
Figure 3F:
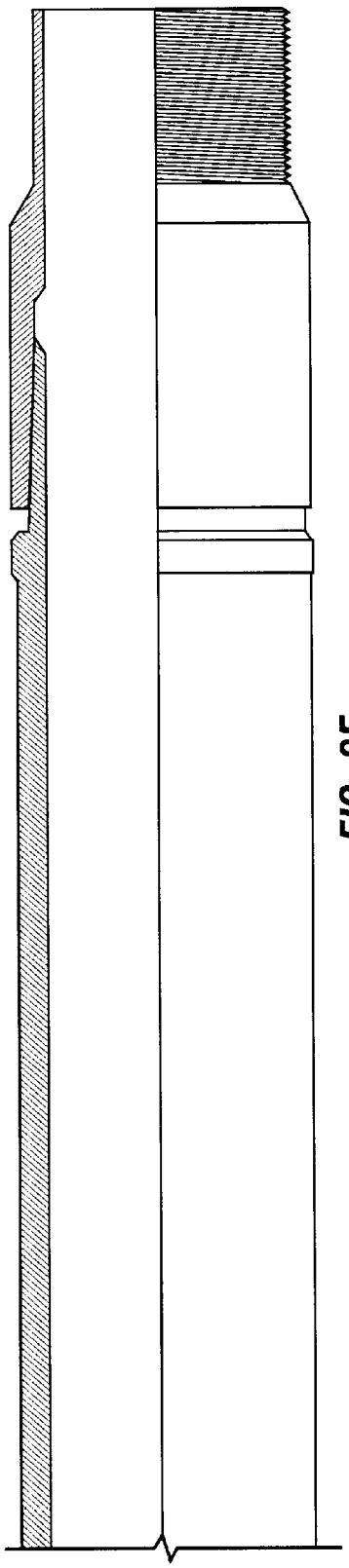
Figure 4F:
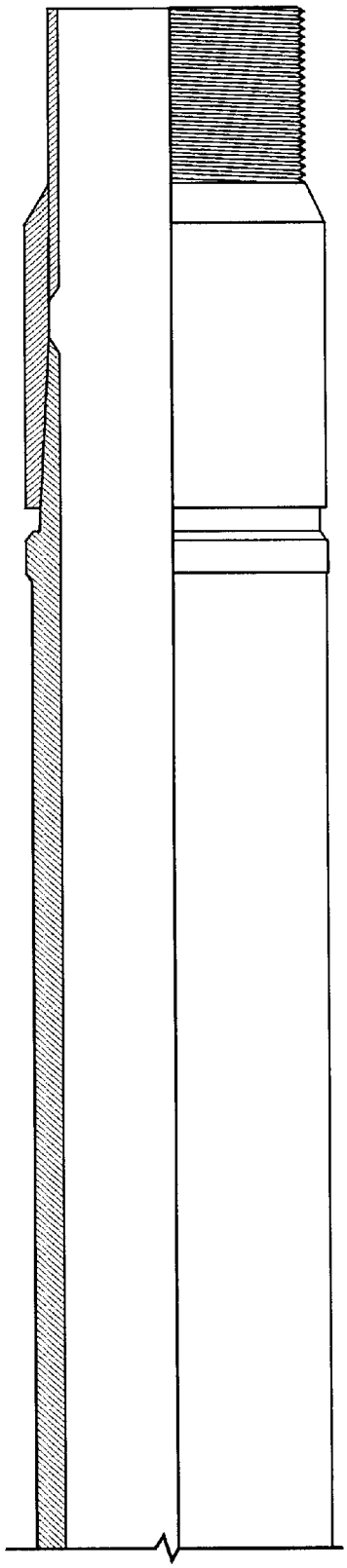
Figure 5A:
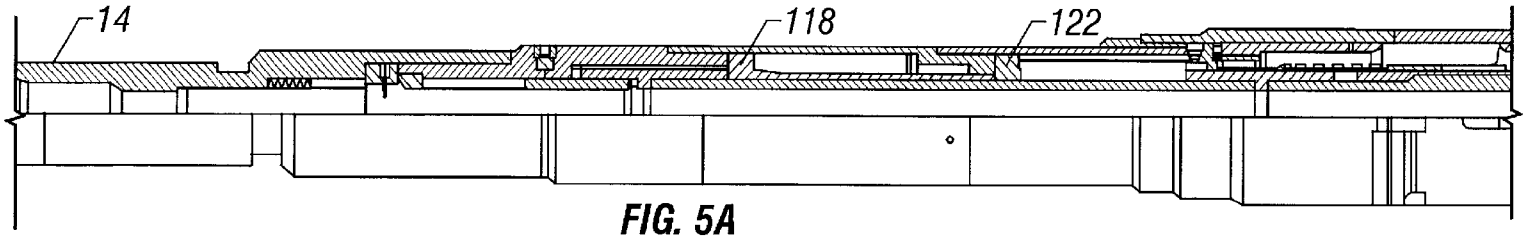
Figure 6A:
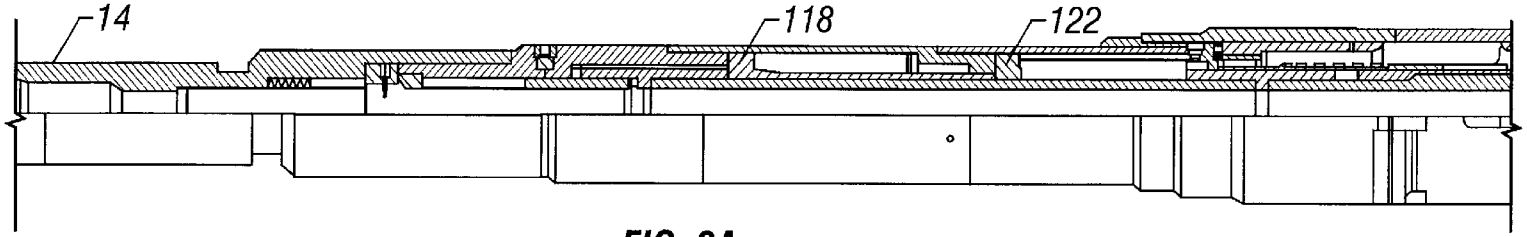

As shown in FIGS. 3D–3E, a set down collar 176 is connected to the housing 12 of the gravel pack tool assembly 12. The set down collar 176 defines an inner profile 177 that is arranged to engage a corresponding profile of a set down collet 178 (FIG. 3E). The collet profile is arranged on the outer surface of the collet. The respective profiles of the set down collar 176 and collet 178 are arranged so that the collet 178 can move past the collar when the collet 178 is moved upwardly past the collar 176 (if the collet 178 is connected to a sleeve 181 by a shear element 180). However, the respective profiles of the collar 176 and collet 178 causes the collet 178 to engage the collar 176 when the collet 178 is moved downwardly in the opposite direction.

The operator mechanism for the ball valve 56 is designed such that the ball valve 56 will actuate open in response to the service tool 14 being lifted and close in response to the service tool 14 being slacked off (or set down). However, in accordance with an embodiment of the invention, the set down collet 178 is locked to the sleeve 181 of the operator mechanism of the ball valve 56 to prevent cycling of the ball valve operator mechanism.

The lower end of the set down collet 178 is attached to the sleeve 181 by the shear element 180. This prevents movement of the set down collet 178 relative to the sleeve 181 and thus prevents cycling of the ball valve 56 in response to upward movement of the service tool 14. Since the collet 178 is locked with respect to the sleeve 181, the collet 178 will rise past the set down collar 176 as the service tool 14 is lifted. The shear element 180 is breakable by a sufficiently large set down force (described below). The locked connection of the set down collet 178 and the sleeve 181 maintains the ball valve 56 in the open position, which is desirable in the embodiment shown to enable communication of an elevated pressure (e.g., hydrostatic pressure) to the target open hole section.

In operation, the service string 3 along with the gravel pack tool assembly 10 are run into the wellbore until the gravel pack tool assembly 10 is positioned in the target open hole section of the wellbore 1. During run-in, the bypass valve 50 is set in its first position, as shown in FIGS. 3A–3F and 10. The ball valve 56 is kept in the open position. At this point, the packer 7 has not been set.

To set the packer 7, a ball 103 (FIG. 4C) is dropped down the tubing 8 into the gravel pack tool assembly 10. The ball 103 is received by the ball seat 110 defined by the upper portion 107 of the collet 104 (FIG. 3A). Note that at this point the collet 104 is in its squeezed position, which prevents the ball 103 from dropping further into the gravel pack tool assembly 10.

Figure 4A:
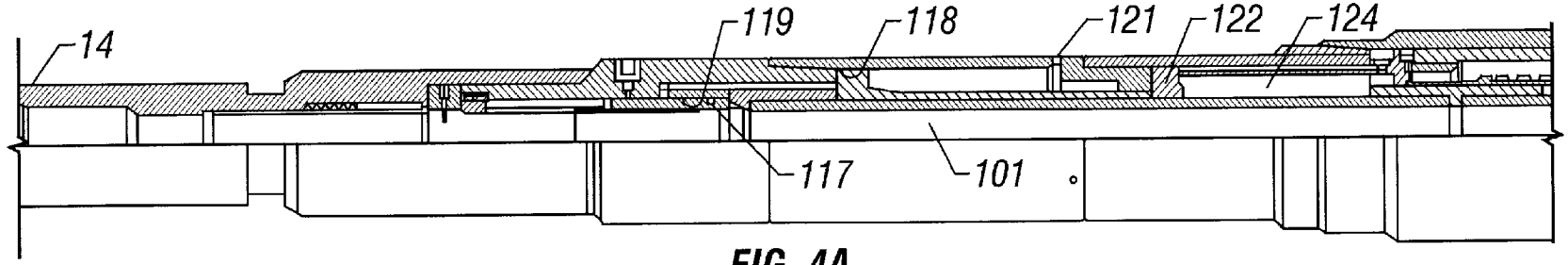
Figure 4C:
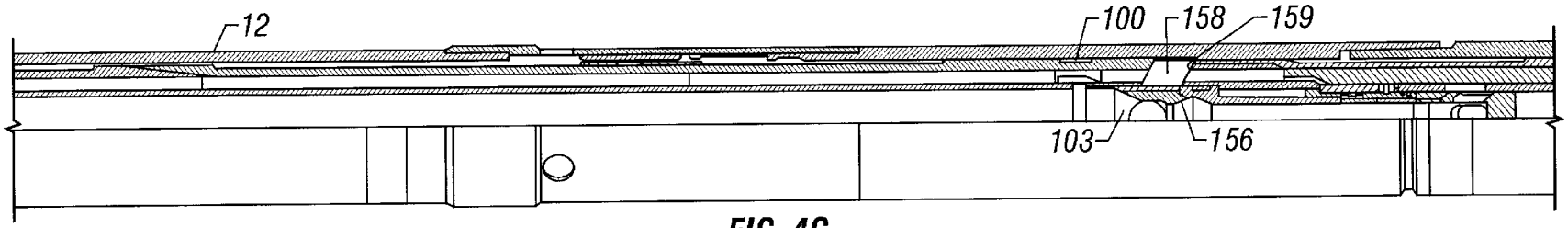

Pressure is increased in the tubing string 8 to set the packer 7. The pressure in the tubing string 8 is increased to some predetermined pressure level over the hydrostatic pressure in the wellbore 1 at the depth of the gravel pack tool assembly 10. The increase in pressure is applied against the ball 103 that is sitting in the ball seat 110 of the collet 104. When the applied pressure is high enough, the shear element 106 is sheared, causing the collet 104 to be moved downwardly by the pressure against the ball 103. Thus, as shown in FIG. 4A, the collet 104 has moved to its down position, where the collet 104 collapses and its upper portion 107 is snapped into the recess 112 provided in the housing member 108. Once the collet 104 is in its collapsed position, the ball seat 110 disappears (FIG. 4A) and the ball 103 is allowed to drop further into the gravel pack tool assembly 10. As shown in FIG. 4C, the ball 103 falls into the ball seat 156. The ball 103 prevents fluid communication to the lower portion of the gravel pack tool assembly 10 through the service tool inner bore 101.

Referring again to FIG. 4A, downward movement of the collet 104 causes the lower seal 117 on the collet 104 to move into an enlarged portion 119 of the housing member 108. As a result, the sealed connection between the collet 104 and the member 108 is removed. This enables the setting pressure in the tubing string 8 to be communicated through the port 115 and conduit 116 to the upper end of the piston 118. The setting pressure causes downward movement of the piston 118 and corresponding downward movement of the piston 122, which in turn causes the setting sleeve 128 to be moved downwardly to compress the seal 126 of the packer 7. Once set, the packer 7 prevents communication of hydrostatic or other elevated pressure directly through the annular path outside the gravel pack tool assembly 10 to the target open hole section of the wellbore 1.

Figure 4D:
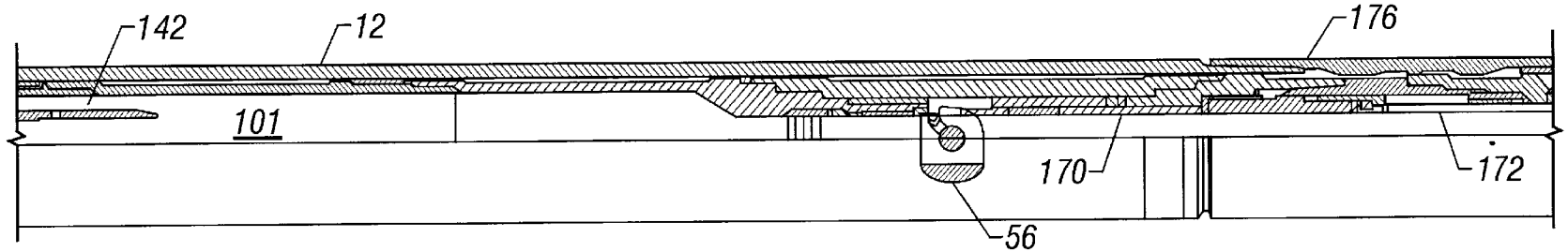

However, note that the bypass valve 50 is in its first position, which enables fluid to flow from the annular region 17 above the packer 7 through the bypass valve 50. The pressure in the annular region 17 flows through the bypass valve 50 into the channel 142 (FIG. 4B), which leads into the service tool inner bore 101 (FIG. 4D). Since the ball valve 56 remains open, the hydrostatic (or other elevated pressure) in the annular region 17 is communicated to the target open hole section. Consequently, even though the packer 7 has been set, the overbalance condition in the target open hole section is maintained to prevent or reduce any swabbing effect due to upward movement of the gravel pack tool assembly 10 during various phases of the gravel packing operation.

After the packer 7 is set, the next phase of the gravel pack operation is to test the packer 7. The annular region 17 has to be isolated to test the packer 7. To do so, the bypass valve 50 is actuated to its second position so that communication between the annular region 17 and the inner bore 101 of the service tool 14 is cut off.

Figure 10:
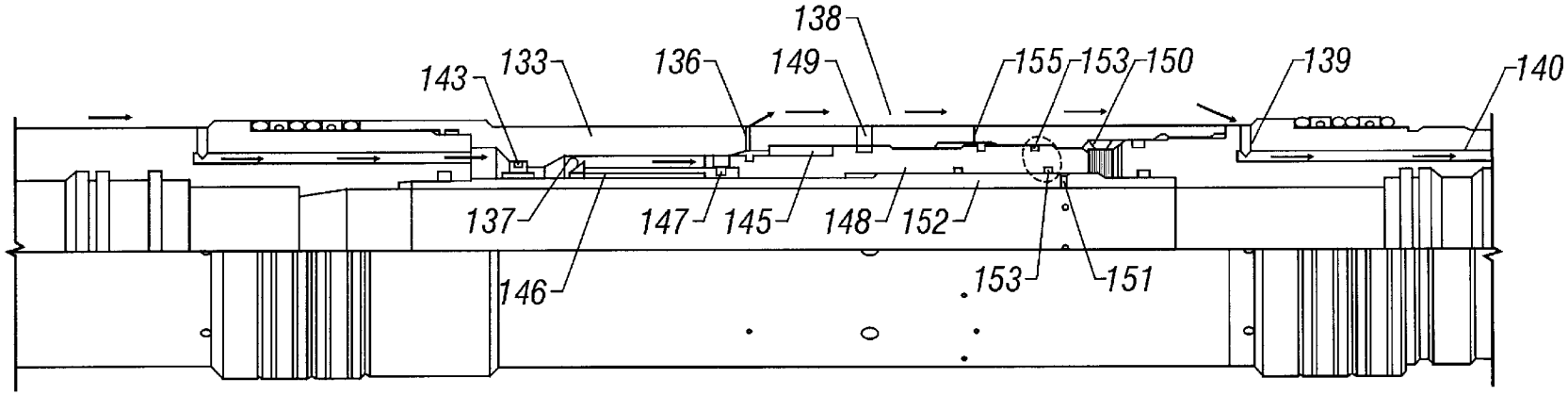
FIGS. 10–15 are longitudinal sectional views of a bypass valve in the tool assembly of FIG. 2A in different positions.
Figure 11:
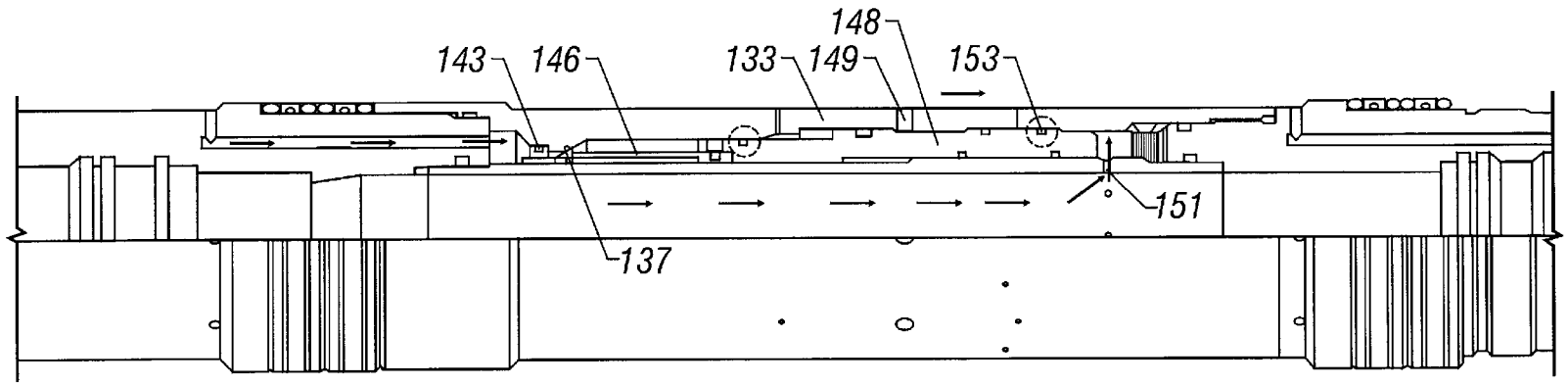
Figure 12:
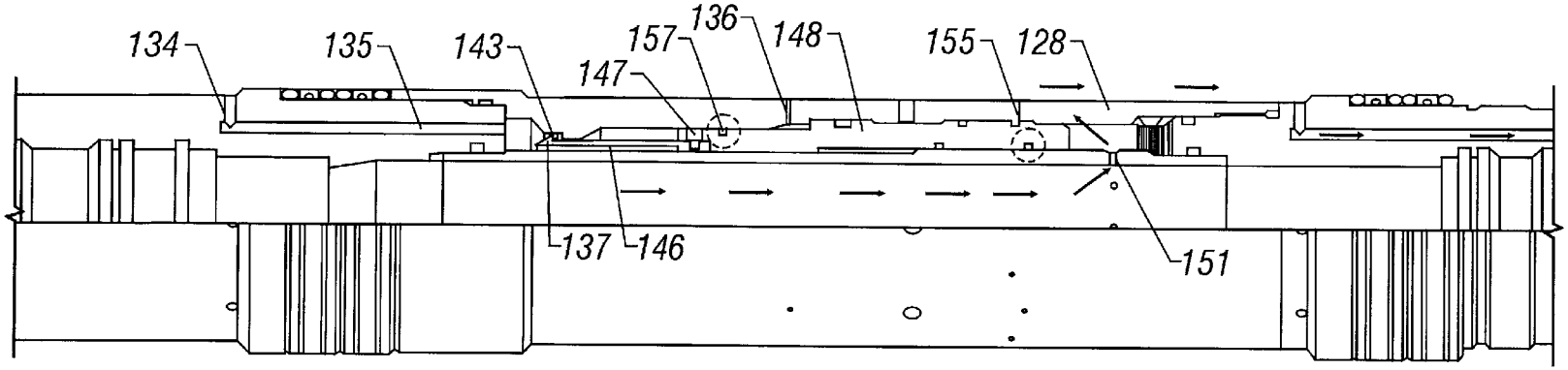

Actuating the bypass valve 50 to the second position is illustrated in enlarged view in FIGS. 11 and 12. Note that the bypass valve actuating piston 148 is initially connected to the bypass valve housing 133 by a shear element 149 (FIGS. 3B and 10). However, if a sufficiently high pressure (greater than the pressure needed to set the packer 7) is applied, then the shear element 149 is broken to enable upward movement of the actuating piston 148.

The applied pressure to actuate the bypass valve 50 to its second position is communicated down the tubing string 8 and through the port 151 to the lower end of the actuating piston 148. If the tubing pressure is at a sufficiently high pressure, the shear element 149 is broken and the actuating piston 148 is moved upwardly. The upward movement of the actuating piston 148 causes a corresponding upward movement of the bypass valve locking collet 146. A locking portion 137 of the locking collet 146 is configured to engage a locking profile 143 in the bypass valve housing 133 in response to the locking collet 146 moving up by a sufficient distance, as shown in FIG. 12. This causes the bypass valve 50 to be locked in the second position.

Note that in the first position (FIG. 10), seals 153 on the actuating piston 148 block fluid communication between the port 151 and a radial port 155 in the bypass valve housing 133. However, as shown in FIG. 12, once the actuating piston 148 has moved upwardly by a sufficient distance, one of the seals 153 clears the port 155 to allow fluid communication to flow from the inner bore 101 of the service tool 14 through the ports 151 and 155 to the conduit 138 between the bypass valve housing 133 and the packer housing 127. As a result, hydrostatic or other elevated pressure in the tubing string 8 is communicated through the bypass valve 50 to the channel 142 that leads to the inner bore 101 of the service tool 14. The ball valve 56 remains in the open position so that the elevated pressure is communicated to the target open hole section is maintained.

In addition to the pressure test, the packer 7 can be subjected to other types of tests, such as picking up and slacking off of the service string 3 to ensure that the packer 7 is sufficiently anchored in the wellbore.

During the pressure test, the pressure in the annular region 17 can be raised to a sufficiently high level so that the service tool 14 is released from the packer 7. Note that the service tool 14 is attached to the packer 7 as the tool assembly 10 is run into the wellbore. Releasing the service tool 14 from the packer 7 enables the service tool 14 to be lifted in subsequent operations.

After testing has been performed, the bypass valve 50 is again re-actuated to its first position. Note that after packer 7 has been tested, isolation of the annular region 17 from the inner bore 101 of the service tool 14 is no longer needed.

Figure 5B:
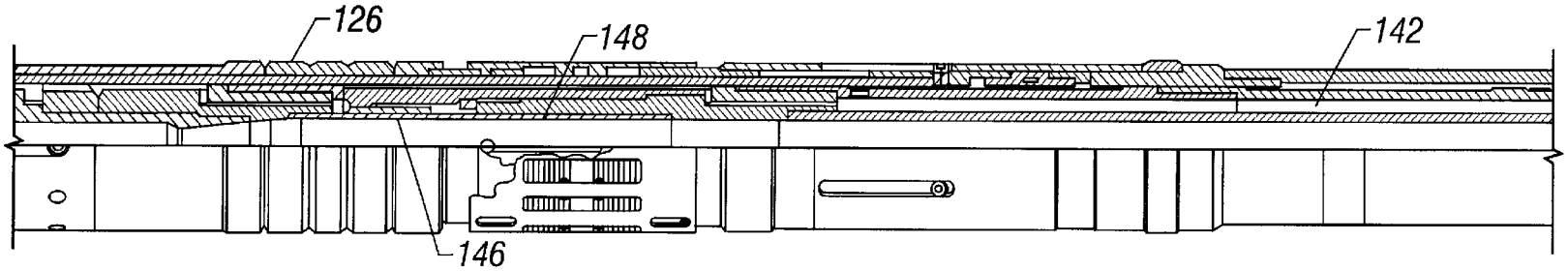
Figure 7D:
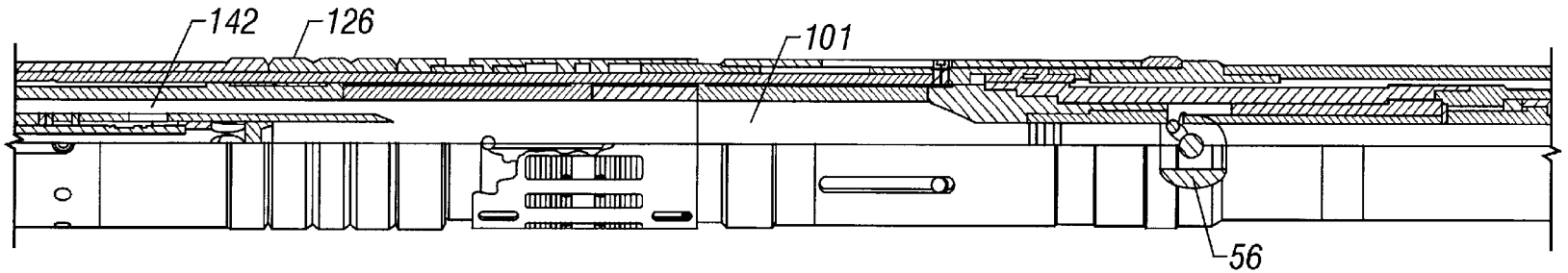
Figure 5C:
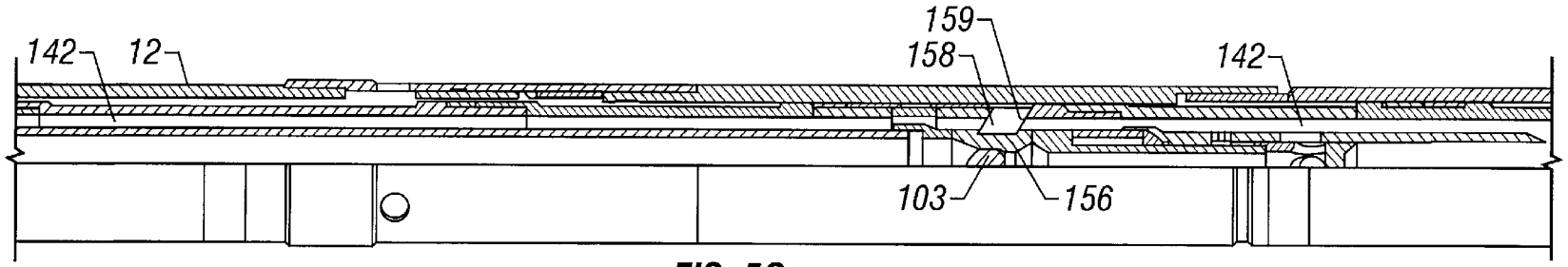
Figure 13:
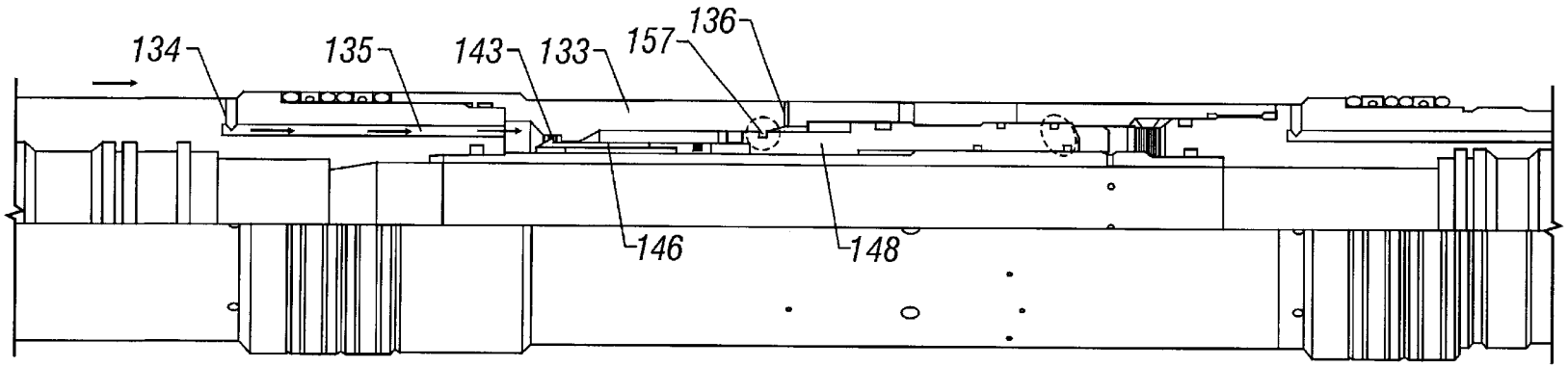
Figure 14:
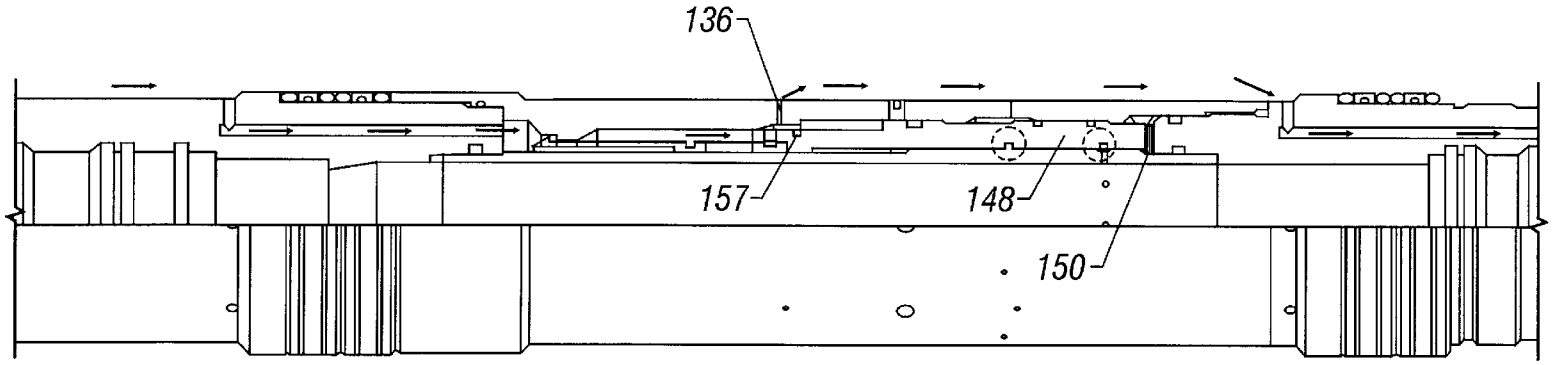

Re-opening of the bypass valve 50 is illustrated in FIGS. 5B and 13–15. A predetermined elevated pressure is communicated down the annular region 17, which is communicated through the packer housing 127 to the port 134 in the bypass valve housing 133. The elevated pressure is communicated down the conduit 135 to the upper end of the actuating piston 148. Note that the locking collet 146 is locked in the locking profile 143. However, the collet 146 is connected to the actuating piston 148 by the shear element 147 (FIG. 12). If a sufficiently high pressure is applied against the upper end of the actuating piston 148 in a downwardly direction, the shear element 147 breaks to allow downward movement of the actuating piston 148, as shown in FIGS. 5B and 13. The applied pressure continues to push the actuating piston 148 downwardly until a seal 157 clears the port 136 in the bypass valve housing 133 (as shown in FIG. 14). This enables communication of the elevated pressure in the annular region 17 out the port 136 to the several conduits that lead to the channel 142 (FIG. 5B). The channel 142 leads to the inner bore 101 of the service tool 14 and through the ball valve 56 to the target open hole section (FIGS. 5C–5F).

Figure 15:
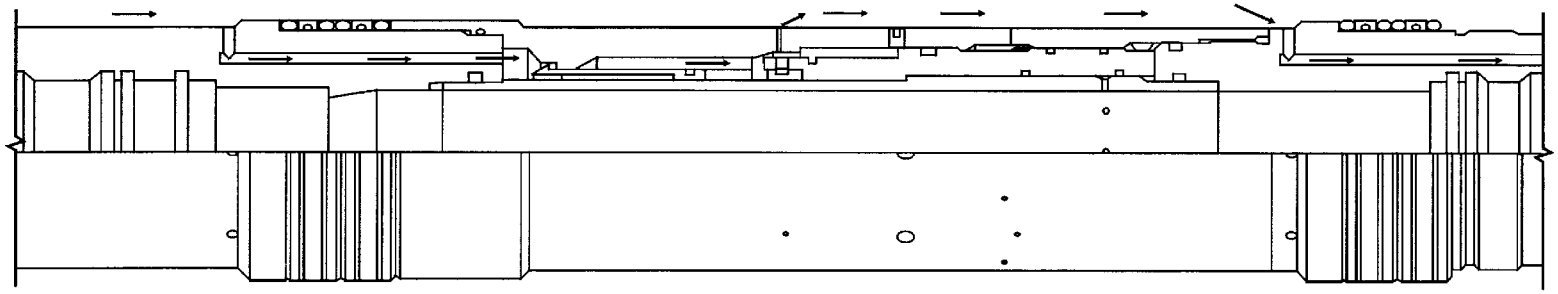

As shown in FIG. 14, the lower end of the actuating piston 148 is entering the ratchet ring 150. The outer surface of the lower end of the actuating piston 148 has a teeth profile for engagement inside the ratchet ring 150. Complete engagement of the lower end of the actuating piston 148 and the ratchet ring 150 is shown in FIG. 15. This locks the actuating piston 148 in its down position, thereby locking the bypass valve 50 in its first position.

Figure 6B:
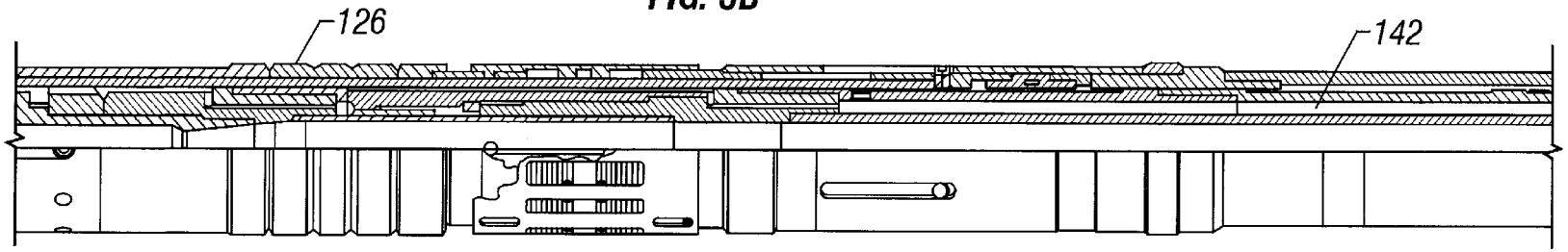
Figure 6C:
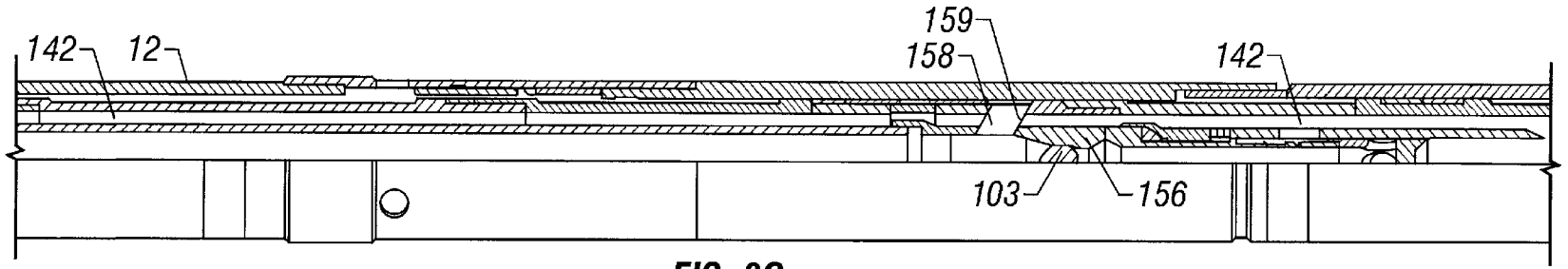
Figure 7E:
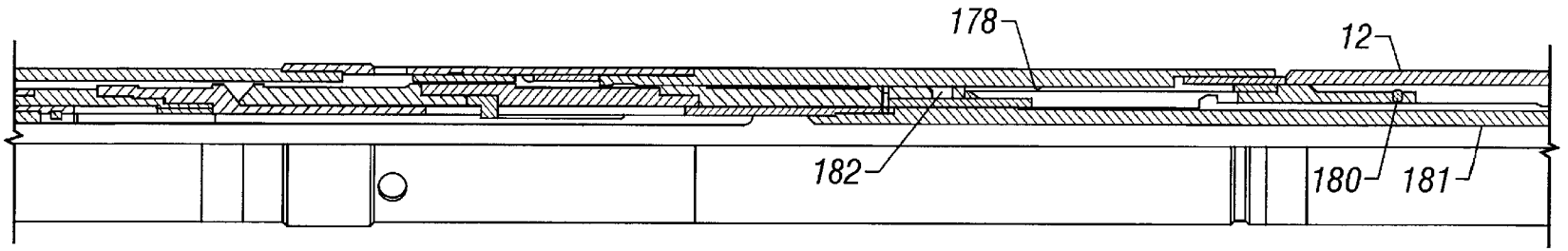
Figure 5D:
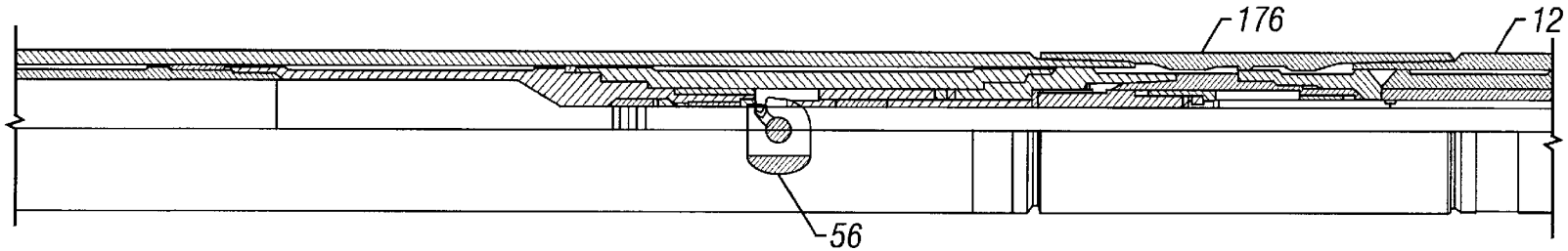
Figure 6D:
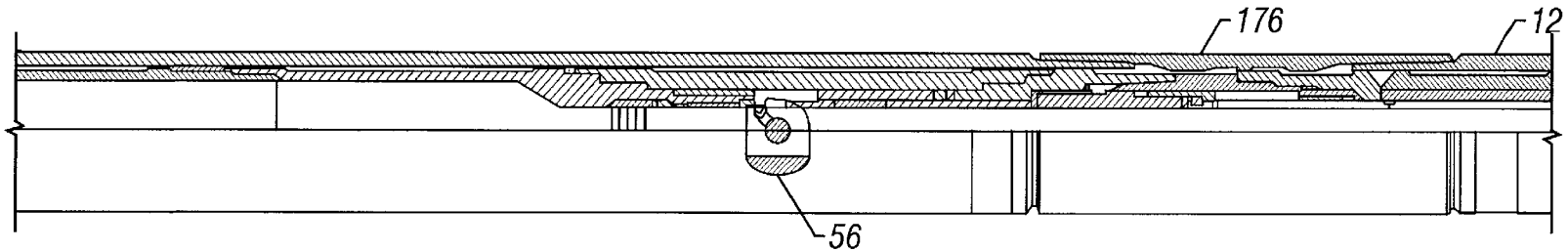
Figure 7F:
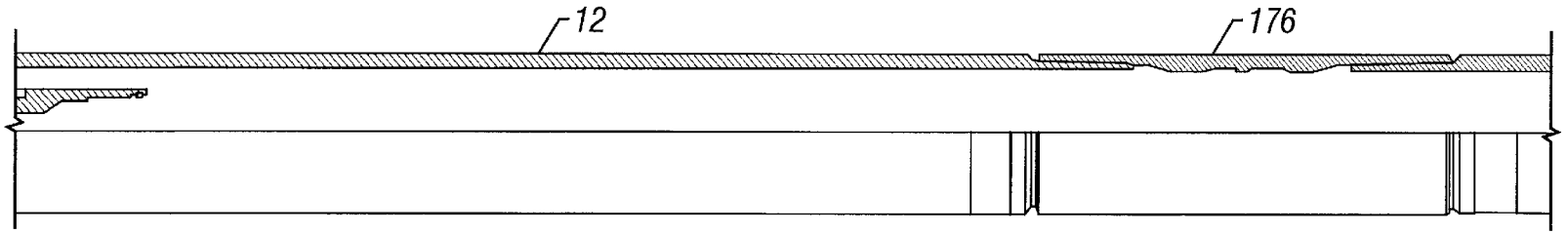
Figure 5E:
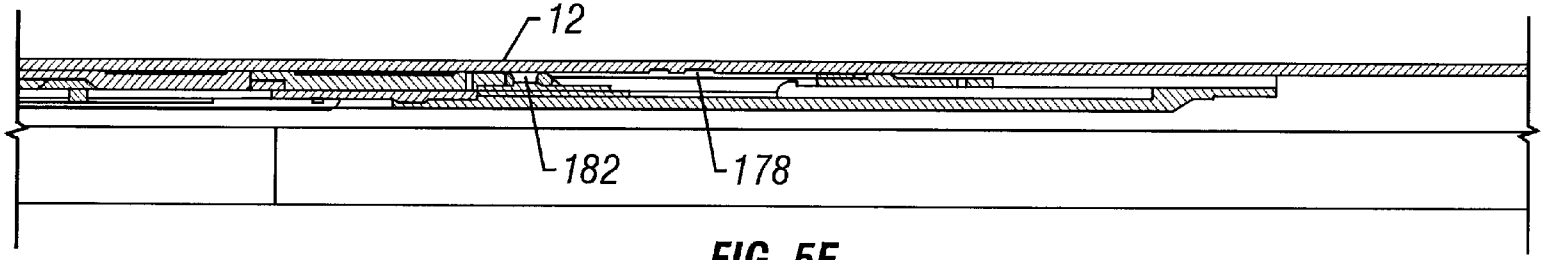
Figure 6E:
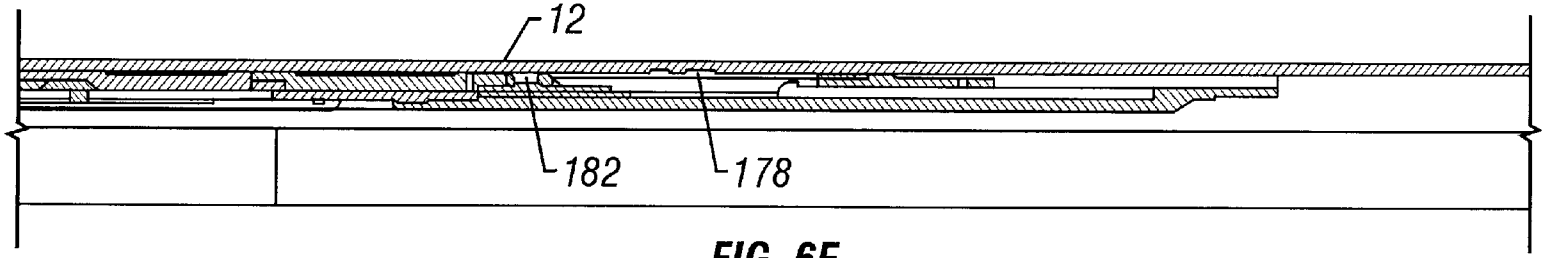
Figure 7G:
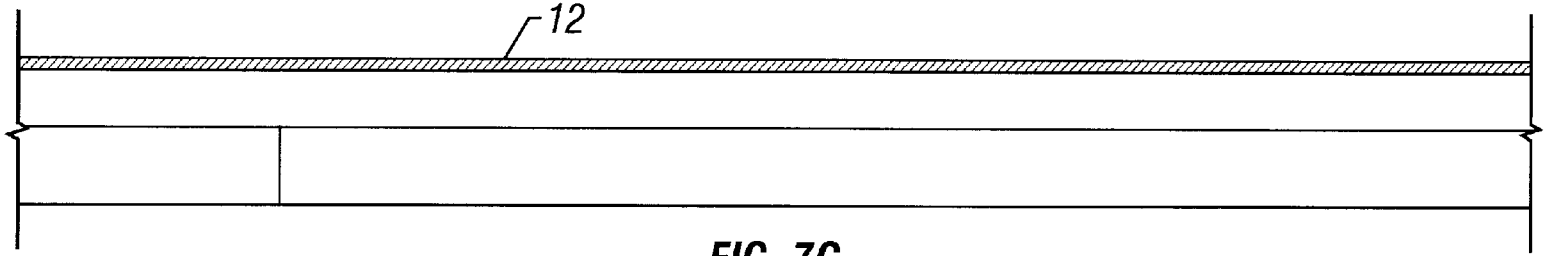
Figure 5F:
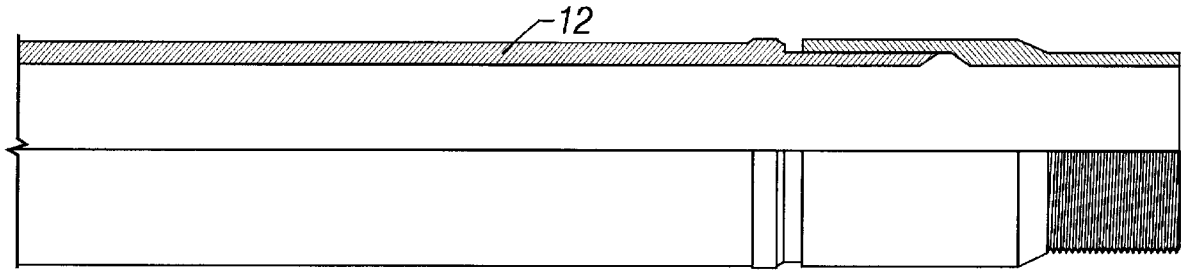
Figure 6F:
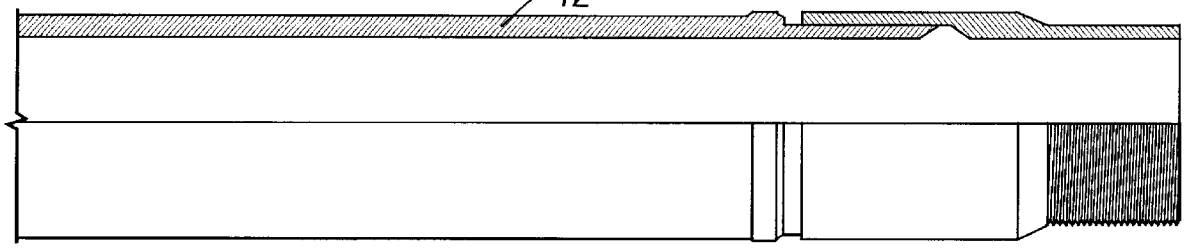
Figure 7H:
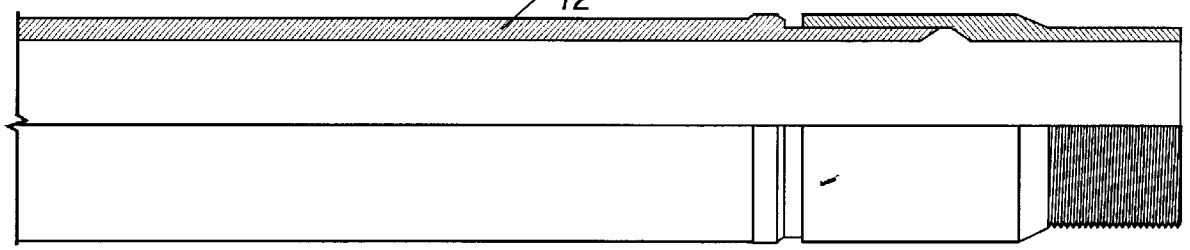
Figure 7A:
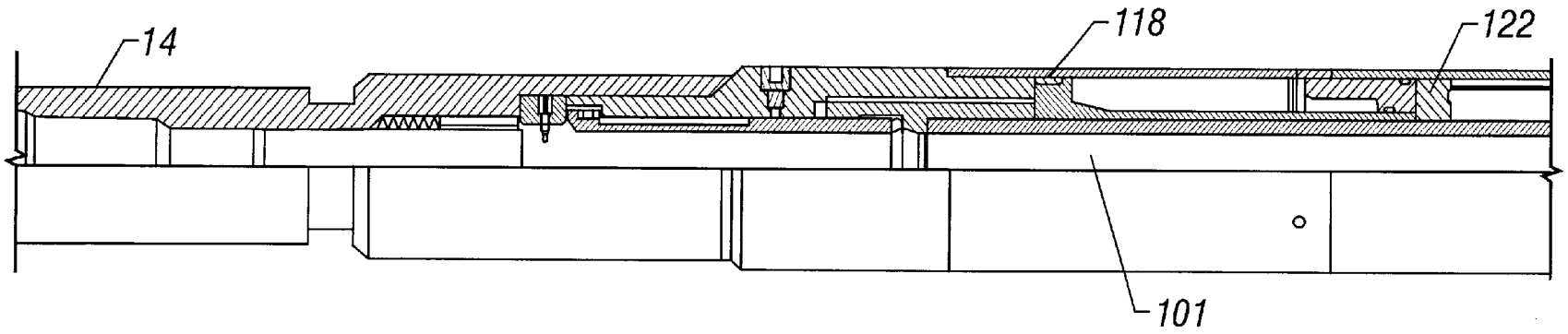
Figure 7B:
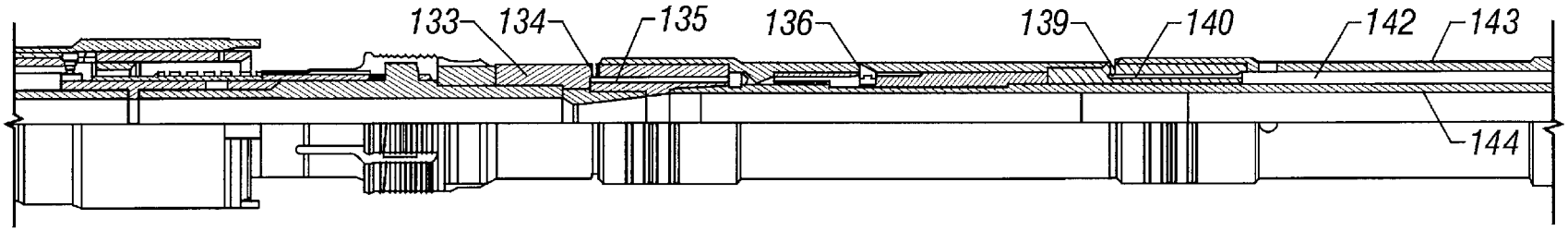
Figure 9B:
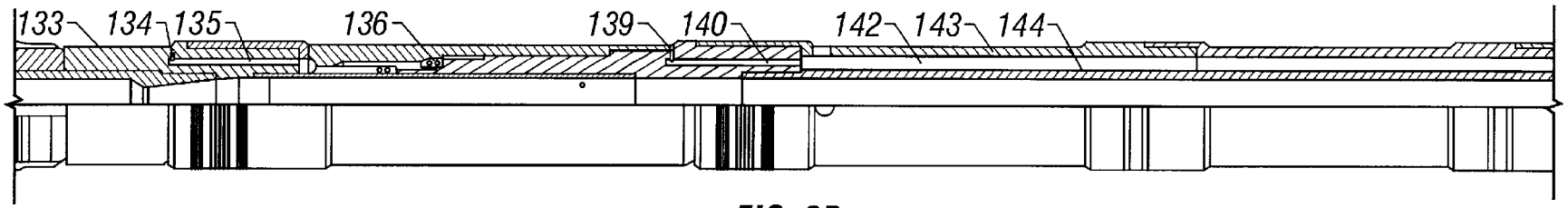

Once the bypass valve 50 has been actuated to its first position, an applied pressure is communicated down the tubing string 8 and service tool inner bore 101 for moving the ball seat 156 (in FIG. 6C). The ball seat 156 is attached to the cross-over port body 159 by a shear element. A sufficiently high pressure in the service tool inner bore 101 causes the shear element to be broken to enable the ball seat 156 to be moved downwardly to uncover the cross-over ports 158.

Figure 7C:
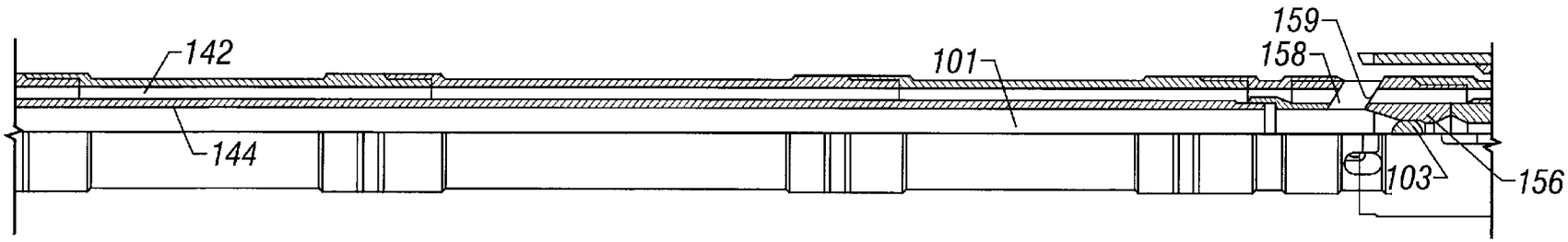

Next, the service tool 14 is raised from the housing 12, as shown in FIGS. 7A–7H. The service tool is raised until the cross-over ports 158 are raised above the packer 7 (FIG. 7C). As the service tool 14 is raised, the set down collet 178 moves past the set down collar 176. The snap force due to the engagement of the set down collar and set down collet provides an indication to the operator at the well surface that the service tool 14 has been raised past the setting collar 176. Note that since the set down collet 178 is locked to the sleeve 181 of the ball valve operator mechanism at this time, the set down collet 178 is able to move with the service tool 14 past the set down collar 176.

Next, a reverse circulation flow is established by forcing fluid flow down the annular region 17, through the cross-over ports 158, and up the service tool inner bore 101 (FIG. 7C). This is used to verify that the service tool 14 is in fact in the reverse position and that the ball seat 156 has been sheared down. In the position shown in FIGS. 7A–7H, communication of hydrostatic pressure to the target open hole section is achieved through the bypass valve 50 (in its first position), channel 142, and ball valve 156 (in its open position). Note that the ball sitting in the ball seat 156 isolates the reverse circulation flow from the lower portion of the gravel pack tool assembly 10.

Figure 8A:
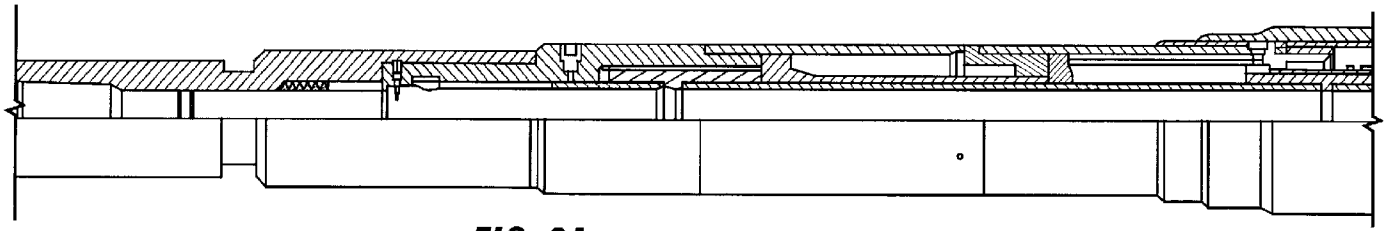
Figure 8B:
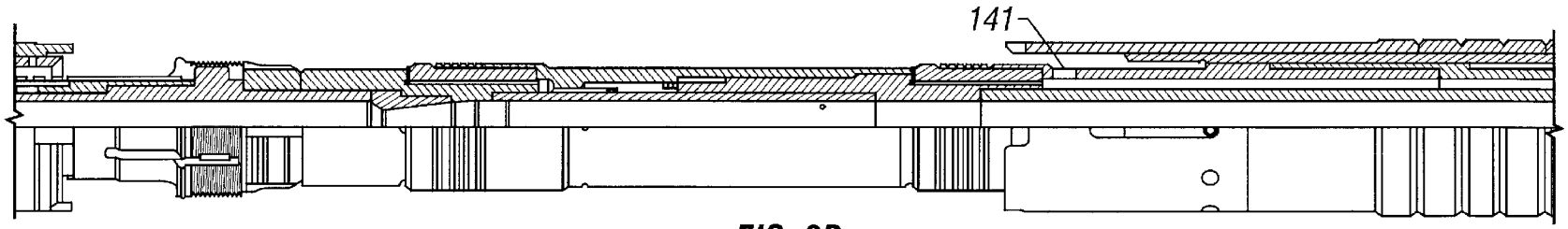

The service tool 14 is then slacked off so that the service tool 14 is lowered until the set down collet 178 is engaged with the set down collar 176. Slack off of the service tool 14 causes a predetermined force to be applied against the set down collar 176 so that the shear element 180 is broken by the set down force (FIG. 8E). Once the shear element 180 is sheared, the set down collet 178 traverses a gap 182 (FIGS. 5E, 6E, 7E) to engage a member 184. However, the ball valve 56 remains open.

Figure 8D:
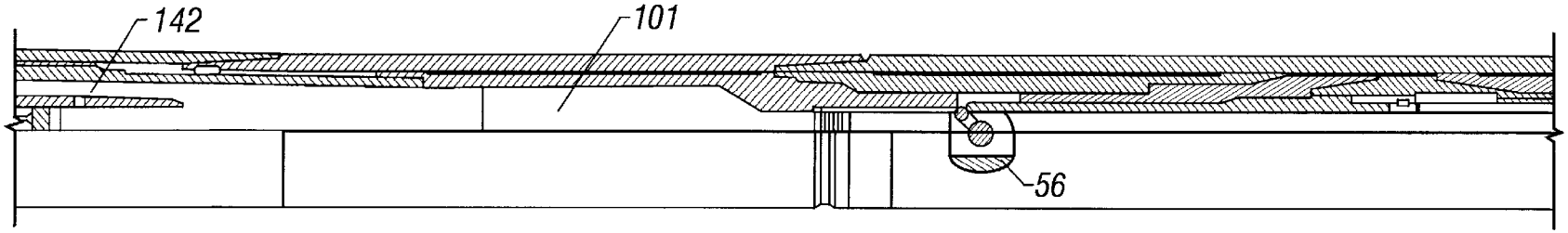
Figure 9E:
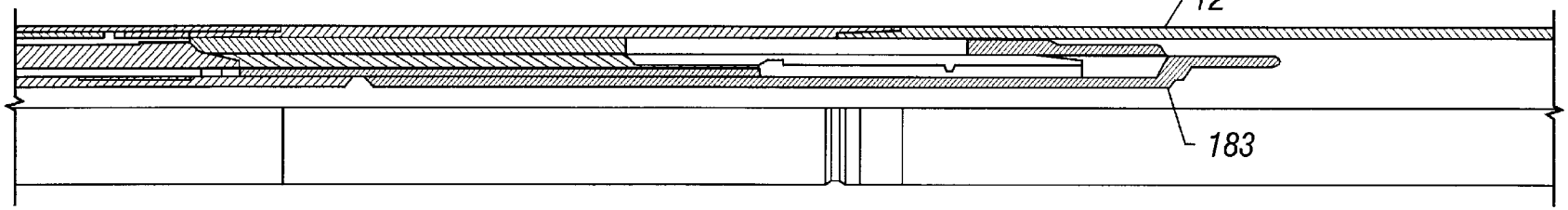
Figure 8E:
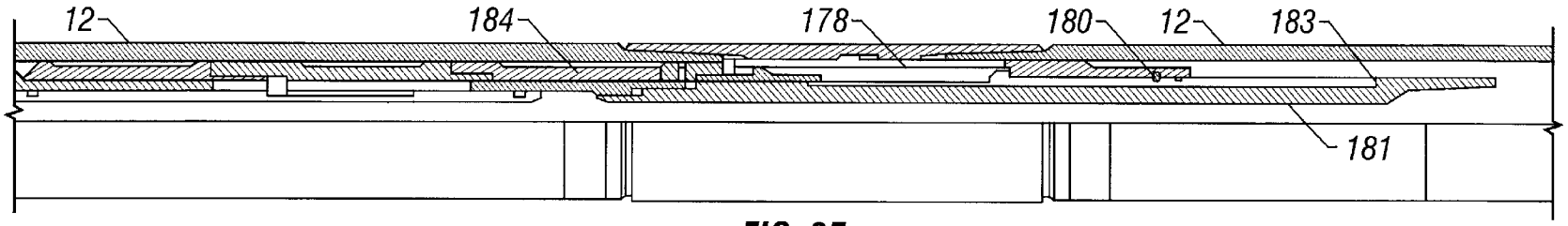
Figure 9F:
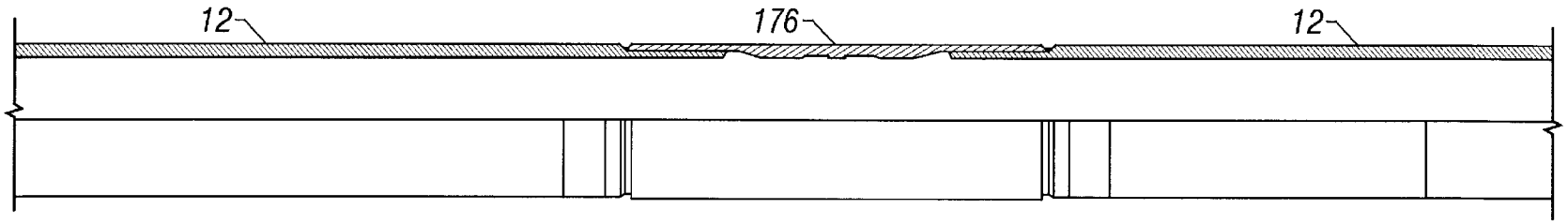
Figure 8F:
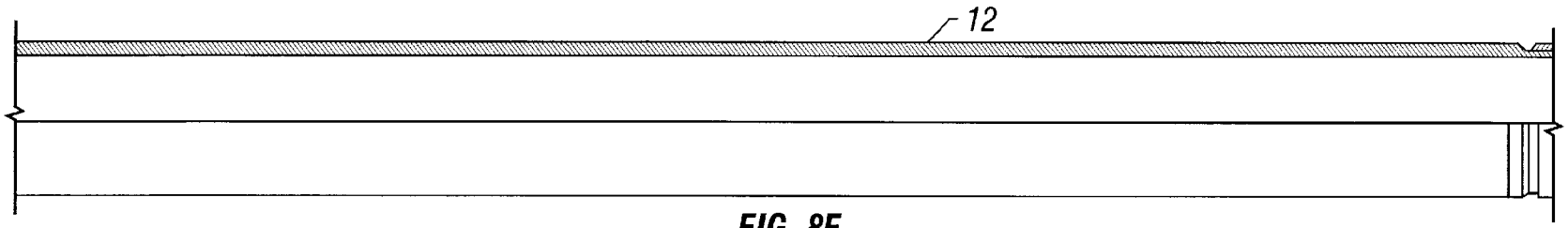
Figure 9G:
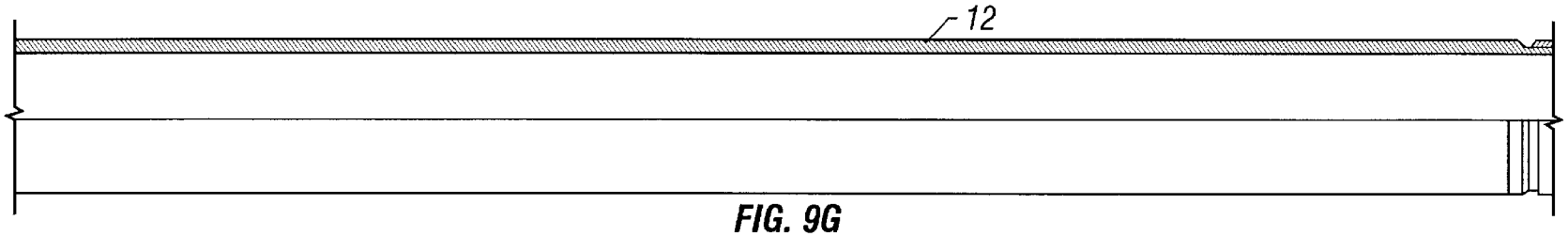
Figure 8G:
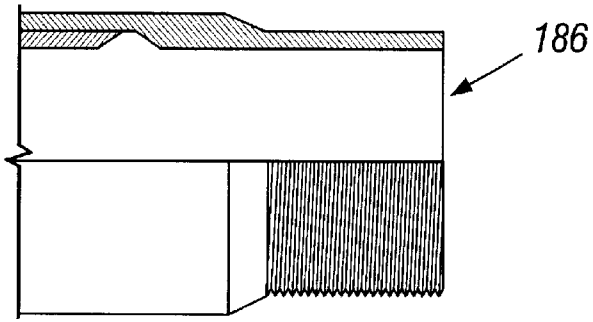
Figure 9H:
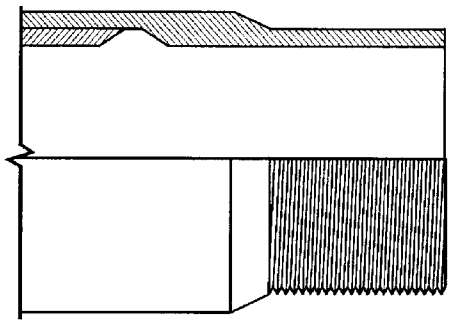
Figure 9A:
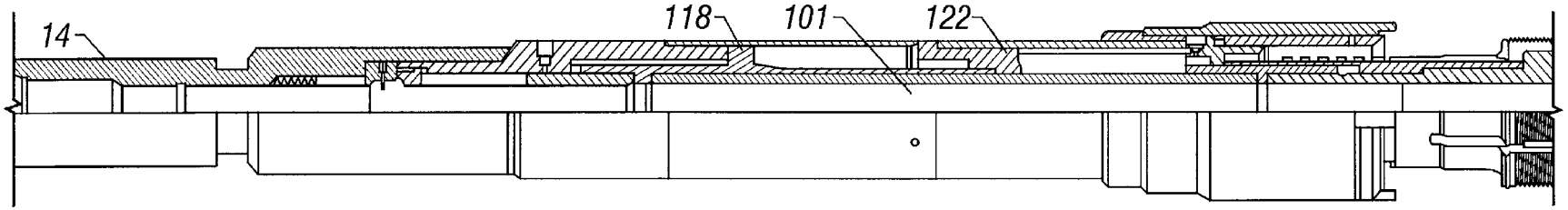

The position shown in FIGS. 8A–8G correspond to the circulate position of the gravel pack tool assembly 10. In this position, a gravel slurry is pumped down the tubing string 8 into the service tool inner bore 101. Since the ball 103 remains seated in the ball seat 156 (FIG. 8C), the gravel slurry is diverted through the cross-over ports 158 into a conduit 161 outside the cross-over port body 159. The gravel slurry flows through the conduit 161 and a port 163 to the annular region outside the housing 12 (annular region 9 in FIG. 2A). The gravel material is deposited in the annular region 9 in the open hole section, while workover fluid is returned through the bottom 186 (FIG. 8G) of the gravel pack tool assembly 10 and up through the bore of the housing 12 (FIGS. 8F–8G).

The return fluid flows up through the service tool inner bore 101, the open ball valve 56, and into the channel 142 (FIG. 8D). The return fluid flows up the channel 142 and exits a port 141 to the annular region 17 (FIG. 8B). The return fluid is flowed back to the well surface through the annular region 17. The process continues until the open hole section outside the gravel pack tool assembly 10 has been completely packed with gravel material.

When this occurs, the tubing string 8 is raised. As the set down collet 178 moves past the set down collar 176, the two components engage. Since the set down collet 176 is no longer locked to the sleeve 181 (shear element 180 has been broken), the collet 176 remains engaged. When the lower end of the collet 176 contacts a shoulder 183 of the sleeve 181, the ball valve operator mechanism is actuated to close the ball valve 56.

Figure 9C:
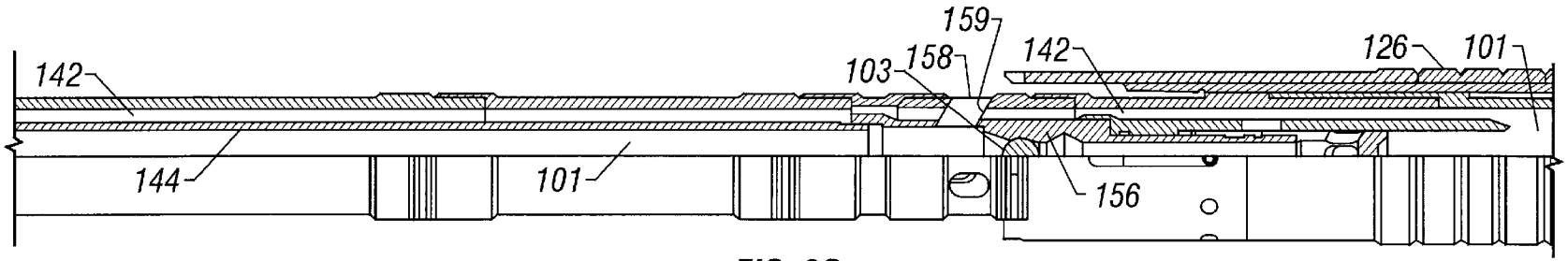
Figure 8C:
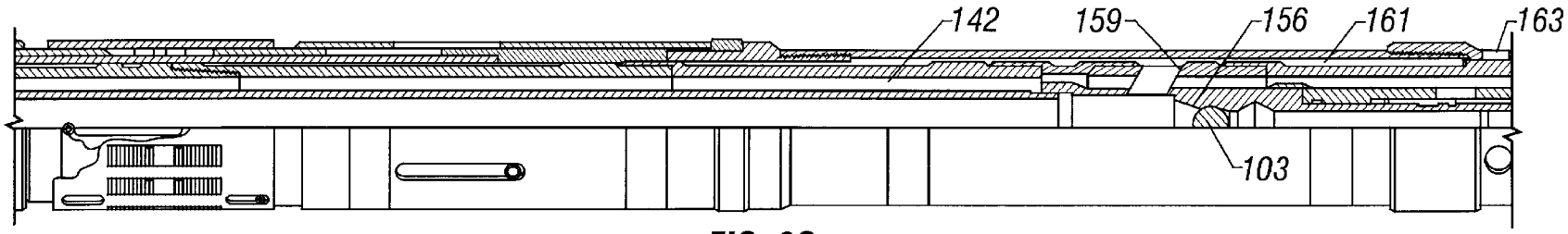
Figure 9D:
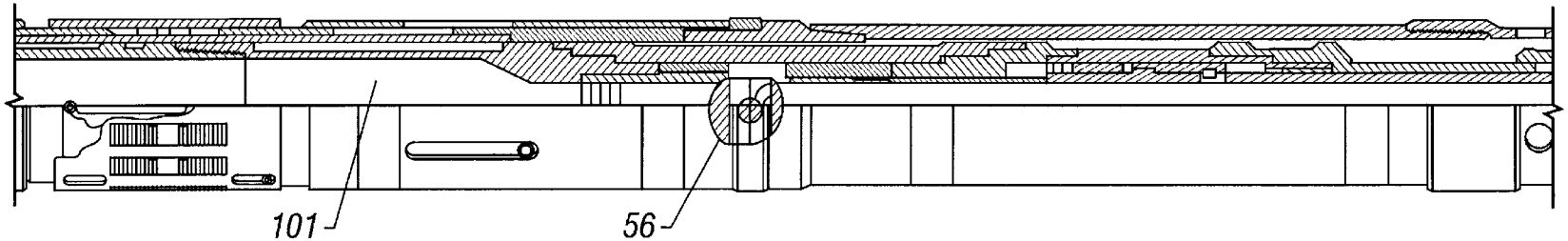

As shown in FIG. 9D, the ball valve 56 has been actuated to the closed position in response to raising the service tool 14. The service tool 14 is raised to the reverse position, in which the cross-over ports 158 are raised above the packer 7 (FIG. 9C). A reverse flow is started to reverse circulate gravel material inside the tubing string 8 and service tool inner bore 101 to the well surface. The reverse circulation flow is pumped down the annular region 17, through the cross-over ports 158, and up the service tool inner bore 101 and tubing string 8.

If desired, the circulate and reverse operations can be repeated to improve the gravel pack in the open hole section of the wellbore. The gravel pack tool assembly 10 thus provides an elevated pressure to a target open hole section during various stages of a gravel pack operation. This reduces the swabbing effect caused by movement of the gravel pack tool assembly 10.

FIGS. 16A–16F, 17A–17F, 18A–18F, 19A–19F, 20A–20H, 21A–21G, and 22A–22H illustrate the tool assembly 10A according to the second embodiment. Many of the elements of the tool assembly 10A are the same as those of the tool assembly 10 shown in FIGS. 3A–3F, 4A–4F, 5A–5F, 6A–6F, 7A–7H, 8A–8G, and 9A–9H. The differences are that the bypass mechanism 300 used in the tool assembly 10A is different from the bypass valve 50 of the tool assembly 10. Also, the flow paths through the bypass mechanism 300 are different than those for the bypass valve 50. Additionally, several flow control elements are included in the bypass mechanism 300 that are not in the bypass valve 50.

Figure 16A:
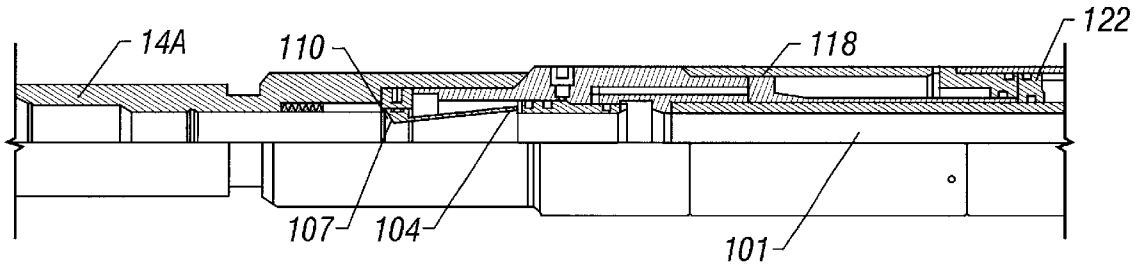
FIGS. 16A–16F, 17A–17F, 18A–18F, 19A–19F, 20A–20H, 21A–21G, and 22A–22H are longitudinal sectional views of the tool assembly of FIG. 2B in different positions.
Figure 17A:
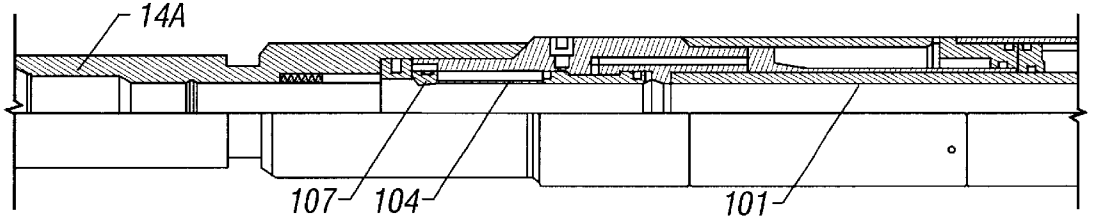
Figure 18A:
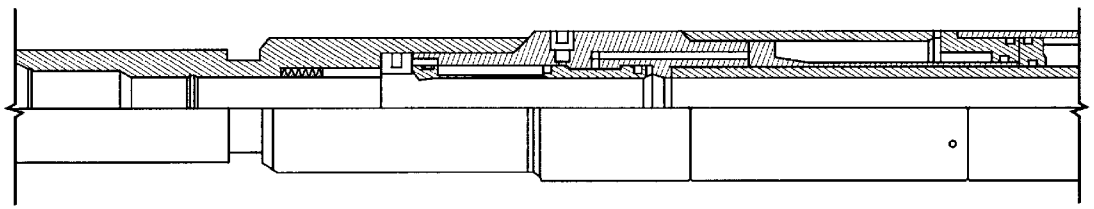

FIGS. 16A–16F show the tool assembly 10A in the run-in position. The service tool 14A is inserted in a seal bore receptacle 400 in the housing 12A of the tool assembly 10A. As shown in FIG. 16A, the service tool 14A also includes the collet 104 that when in its squeezed position (as illustrated in FIG. 16A) defines the ball seat 110 to receive the ball 103 dropped from the well surface. The service tool 14A also includes the piston 118 and the piston 122 (which collectively make up the setting piston) for setting the packer seal 126.

Figure 16B:
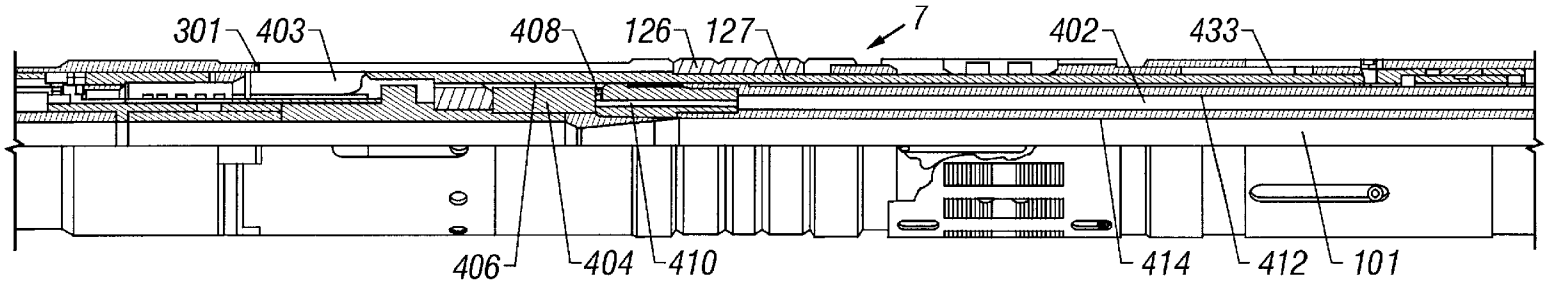
Figure 17B:
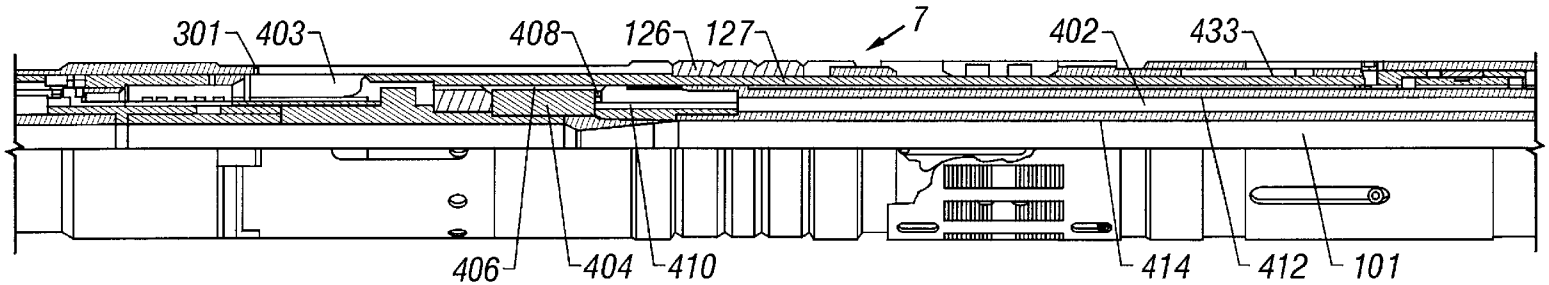
Figure 18B:
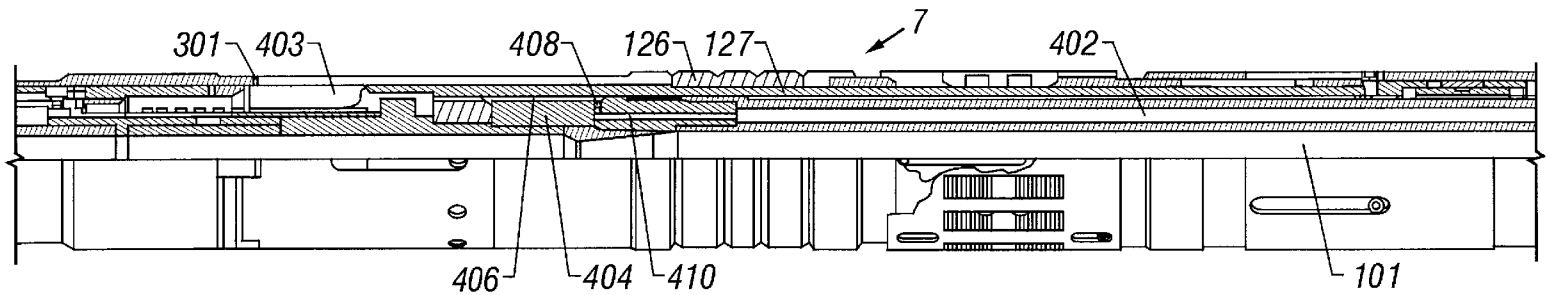

As shown in FIG. 16B, fluid from the annular region 17 flows through the port 301 into a chamber 403 inside the packer 7. The fluid in the chamber 131 flows through a conduit 406, a port 408, and another conduit 410 defined in a housing 404 of the bypass mechanism 300. The conduit 410 leads to another conduit 402 that is defined between the housing 412 and inner sleeve 414 of the bypass mechanism 300.

The conduit 402 communicates with a conduit 417 defined in a connector member 416. A radial port 418 provides fluid communication between the conduit 417 and a conduit 420 defined between the housing 12A and the outer housing 432 of the service tool 14A.

Figure 16C:
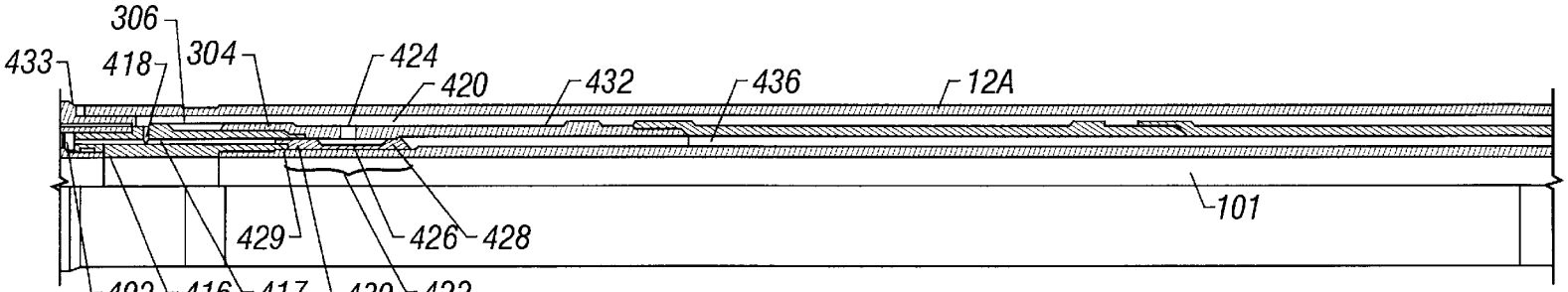
Figure 17C:
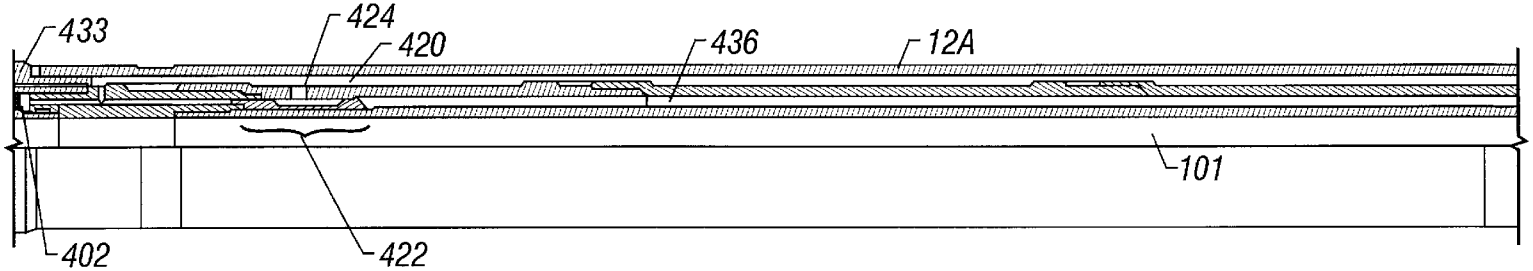
Figure 18C:
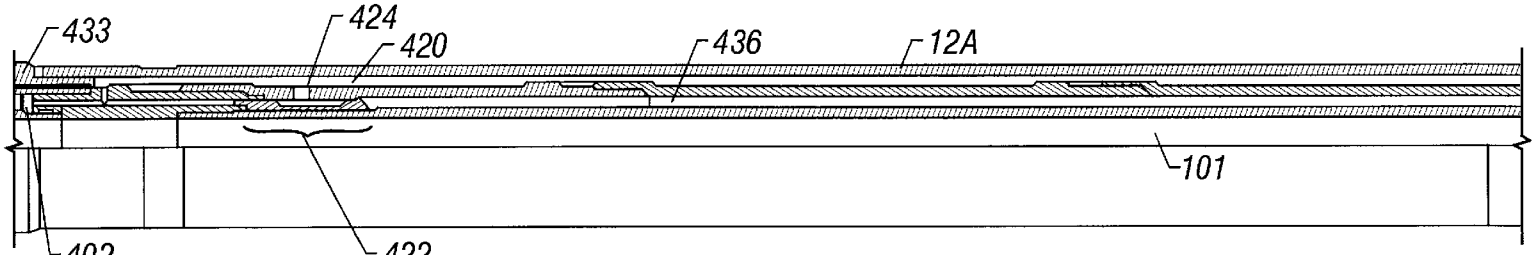

Also shown in FIG. 16C is a return port valve 422 that controls fluid flow through one or more ports 424. The return flow valve 422 includes a sleeve member 426 that has a first enlarged portion 428 with a seal thereon to engage an inner surface of the service tool housing 432. The other end of the sleeve member 426 is also an enlarged portion 429 having a seal thereon to engage the inner surface of the service tool housing 432. The sleeve member 426 is connected to the inner sleeve 414 of the service tool 14A by a shear element 430. In the position shown in FIG. 16C, the one or more ports 424 are closed by the sleeve member 426.

Figure 16D:
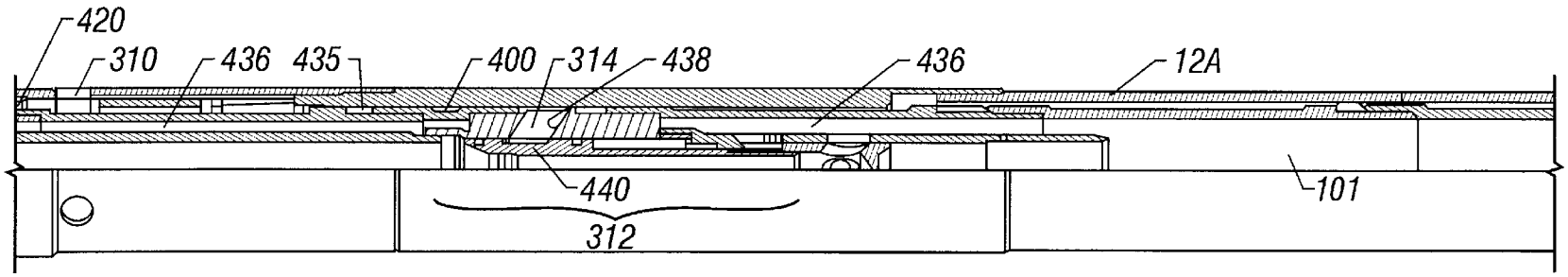

As shown in FIGS. 16C–16D, the flow channel 420 extend along the tool assembly 10A until it reaches the one or more ports 310 formed in the housing 12A of the tool assembly 10A. The ports 310 lead to the annular region 9 outside the tool assembly 10A below the packer 7.

As shown in FIGS. 16B–16C, the conduits and ports 406, 408, 410, and 402 make up the conduit 302 in FIG. 2B. The conduit 420 of FIGS. 16C–16D makes up the conduit 308 of FIG. 2B.

As discussed above in connection with FIG. 2B, the flow control element 304 (FIG. 16C), which in one embodiment is in the form of a sleeve, controls flow between the conduit 302 (collection of 406, 408, 410, 402) and the conduit 308 (420). The outer surface of the flow control sleeve 304 carries the sealing element 306. In the position shown in FIG. 16C, the port 418 is able to communicate with the conduit 420. However, the flow control sleeve 304 is also moveable upwardly to move the sealing element 306 into contact with an inner surface of housing sections 433 of the packer 7 to block off the port 418 and thereby blocking communication between the conduits 402 and 420.

As shown in FIGS. 16C–16D, another conduit 436 runs generally in parallel with the conduit 420. The conduit 436 is provided between the sleeve 416 and outer housing 432 of the service tool 14A. The conduit 436 leads through the cross-over mechanism 312 and into the inner bore 101 of the service tool 14A.

The cross-over mechanism 312 includes one or more cross-over ports 314 defined in a cross-over port body 438. Arranged inside the cross-over port body 438 is a ball seat 440 to receive the ball 103 that is dropped from the well surface through the tubing string 8.

Figure 16E:
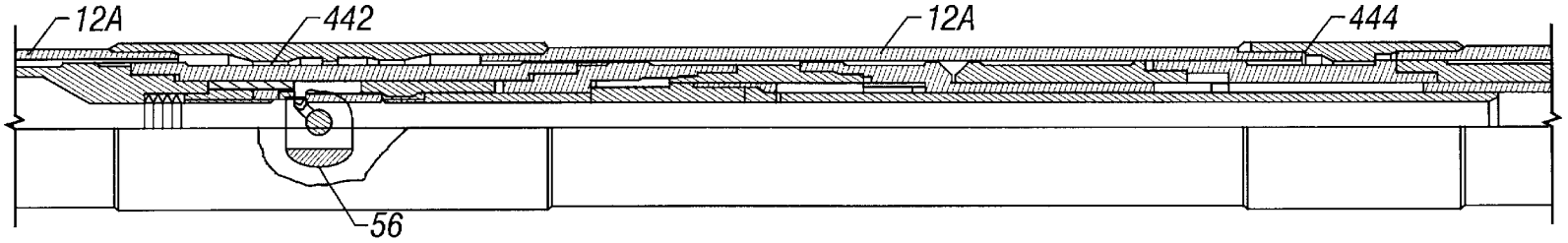
Figure 17E:
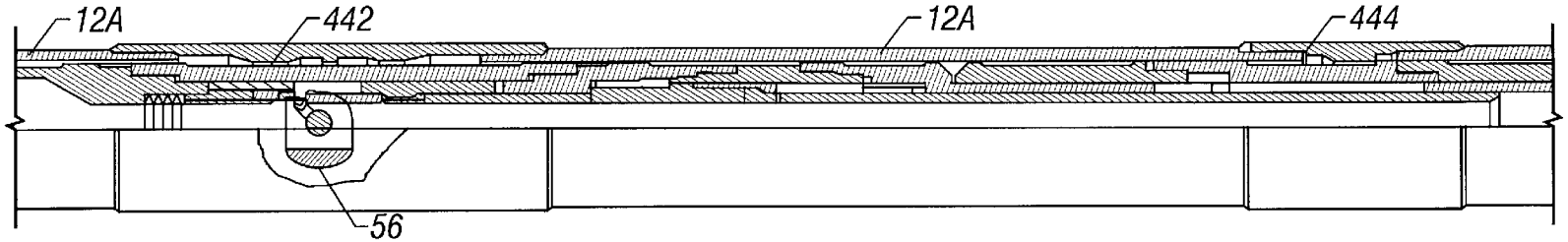
Figure 18E:
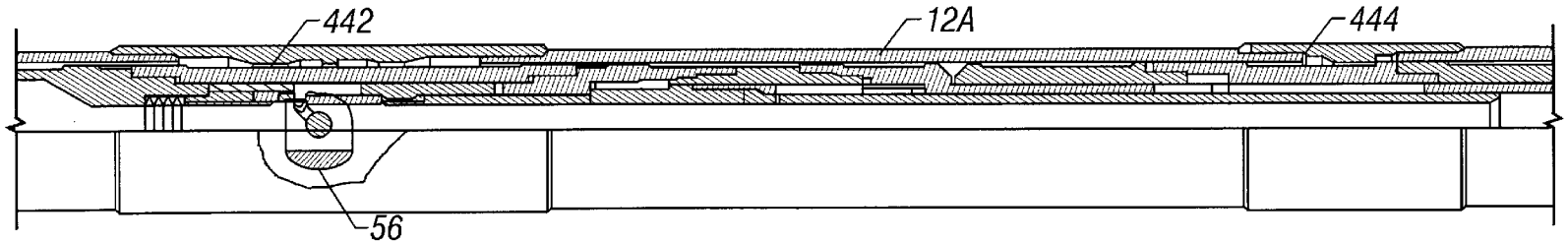
Figure 16F:
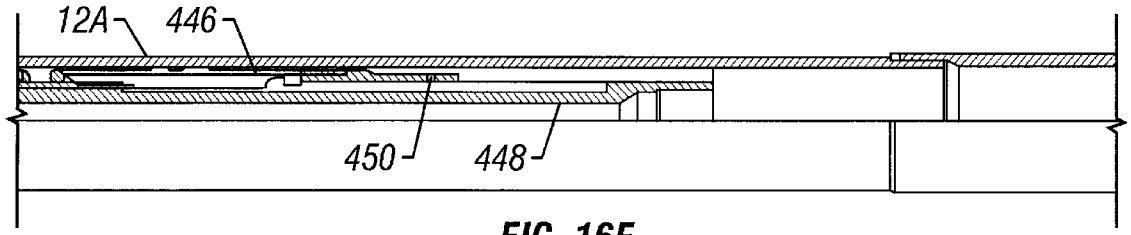
Figure 17F:
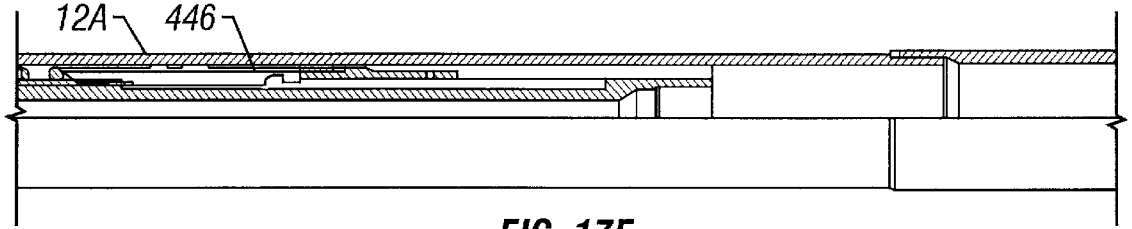
Figure 18F:
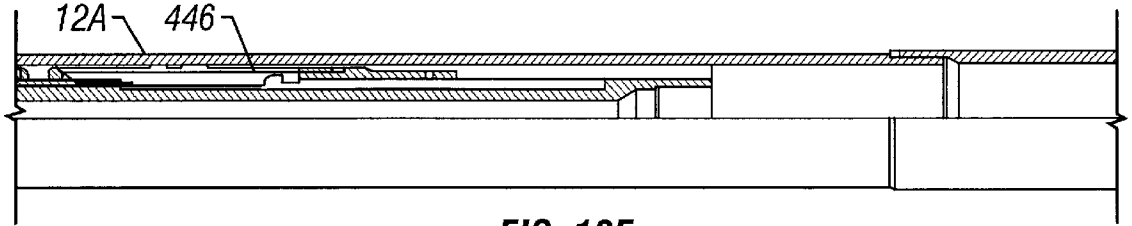
Figure 20C:
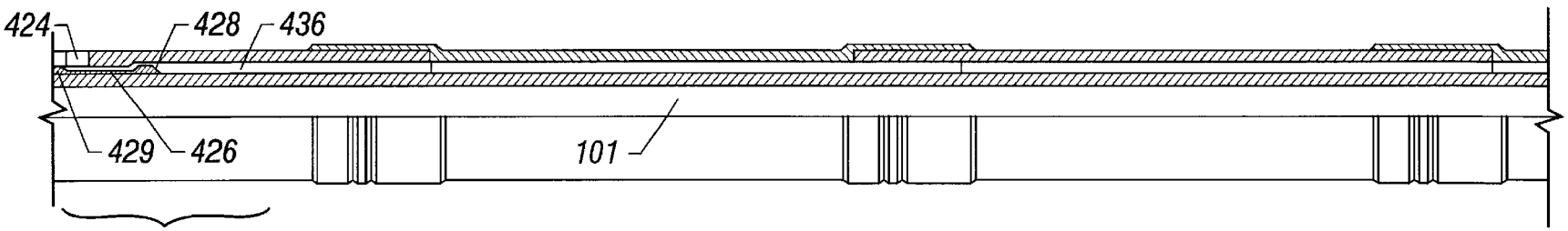

The service tool 14A also includes a ball valve 56 in one embodiment. As shown in FIG. 16E, the ball valve 56 is in its open position. Proximal the ball valve 56 is a set down collar 442 that is attached to the housing 12A. Another collar 444 is attached to the housing 12A below the set down collar 442. The collar 444 is referred to as an interference collar. The interference collar 444 provides an indication to an operator at the well surface of a desired packer pressure test position. Before the packer test can be performed, the bypass mechanism 300 is set to the second position to isolate the annular region 17. The bypass mechanism 300 is lifted to the second position. The distance to lift the service tool 14 is indicated by an interference force due to engagement of the set down collet 446 with the interference collar 444.

The set down collet 446 has an outer profile to engage with corresponding profiles of the interference collar 444 and set down collar 442. The set down collet 446 is attached to a sleeve 448 (part of the ball valve operator mechanism) by a shear element 450. The locked position of the set down collet 446 with respect to the locking member 448 prevents actuation of the ball valve 56 (so that the ball valve 56 can be maintained in the open position). As described below, and in a manner similar to that of the tool assembly 10, the shear element 450 is broken by a set down force applied when the service tool 14A is slacked from a reverse position to the circulate position (as shown in FIGS. 20A–20H and 21A–21G).

In operation, the tool assembly 10A is lowered into the wellbore 1 in the position shown in FIGS. 16A–16F. As the service string 3 is run into the wellbore 1, washdown fluid is pumped down the string. The washdown fluid exits the bottom end of the string and returns in the annular region outside the string. This washes out debris that may be present in the wellbore. However, note that the conduit 436 (which is a return flow path) is open to the bore 101 of the service tool 14A, as shown in FIG. 16D. Thus, if the return port valve 422 (FIG. 16C) is not present or open, the washdown fluid will want to flow up the conduit 436 instead of to the bottom end of the string. To prevent this, the return port valve 422 is initially set in the closed position.

Figure 17D:
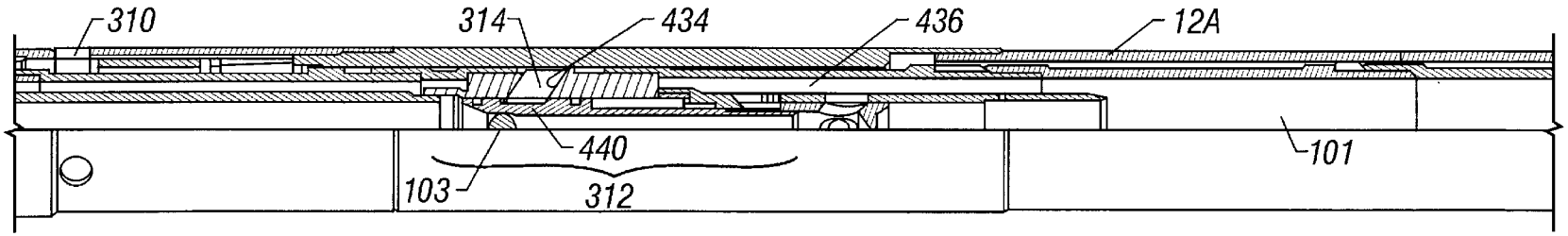

Next, the ball 103 is dropped through the tubing string 8 from the well surface. The ball is received by the ball seat 110 (FIG. 16A), and tubing string pressure is increased to push the collet 104 downwardly. This enables communication of the tubing string pressure against the pistons 118 and 122 for setting the packer seal 126. When the collet 104 is pushed downwardly, it collapses to enable the ball 103 to fall down further to engage the ball seat 440 (FIG. 17D). Since the ball 103 engaged in the ball seat 440 isolates the pressure in the tubing string from the target openhole section, the increased tubing string pressure is communicated to the pistons 118 and 122.

Although the packer 7 is set, a fluid path is established through the bypass mechanism 300 to communicate the hydrostatic pressure or other elevated pressure in the annular region 17 to the target open hole section. Unlike the tool assembly 10, however, the communication of the annular region 17 pressure does not go through the ball valve 56 at this point, but rather flows out the one or more ports 310 to the annular region outside the tool assembly 10A.

After the packer 7 is set, a pull-test of the packer 7 is performed. This is accomplished by pulling on the tubing string 8 with a predetermined force to determine if the slips of the packer 7 is appropriately engaged to the inner surface of the wellbore 1.

Figure 18D:
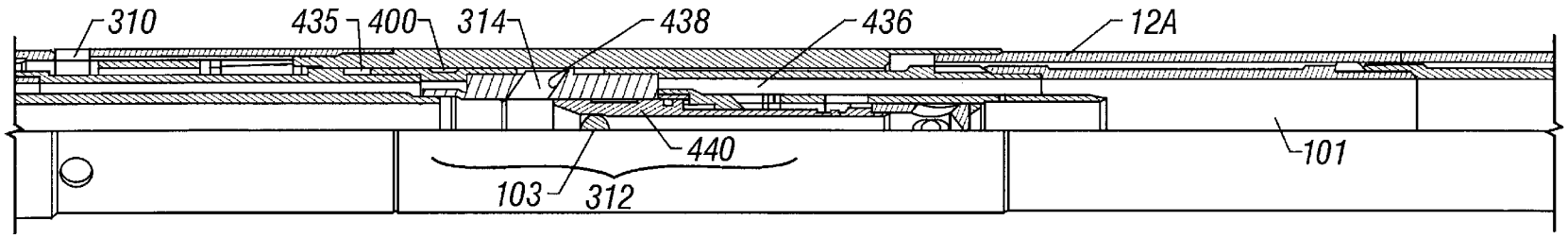

Also, as shown in FIG. 18D, an interior pressure in the tubing string 8 is increased to shear a shear element attaching the ball seat 440 to the cross-over port body 438 so that the ball seat 440 is moved downwardly to uncover the cross-over ports 314. In the position of FIGS. 18A–18F the b ass valve mechanism 300 is still in its first position.

The next phase of the gravel pack operation is to pressure test the packer 7. This is accomplished by pulling on the tubing string 8 so that the service tool 14A is raised by a predetermined amount, as shown in FIGS. 19A–19F. Raising the service tool 14A as shown in FIGS. 19A–19F causes the flow control sleeve 304 to move upwardly so that the sealing element 306 engages the inner wall of the housing segment 433 of the packer 7. As a result, the port 418 is blocked (see FIG. 19B) so that fluid communication between the conduits 402 and 420 is prevented. This corresponds to the second position of the bypass mechanism 300, which effectively isolates the annular region 17 from the open hole section so that the pressure can be increased in the annular region 17 to pressure test the packer 7.

Note, that the raised position of the service tool 14A causes the cross-over ports 314 of the cross-over mechanism 312 to be aligned with the ports 310 of the housing 12A. As a result, the cross-over port mechanism 312 is in its open position so that fluid communication is possible between the inside of the tubing string 8 and the annular region outside the tool assembly 10A. Thus, hydrostatic pressure or some other form of elevated pressure is communicated through the cross-over ports 314 and ports 310 to the target open hole section. As a result, an overbalance condition is maintained in the target open hole section.

As the service tool 14A is raised to its position in FIGS. 19A–19F, it is desired that an elevated pressure be communicated at all times to the target open hole section. In one embodiment, this is enabled by opening communication through the cross-over ports 314 before flow through the port 418 is completely blocked. The transition is shown in FIGS. 23 and 24.

Figure 23:
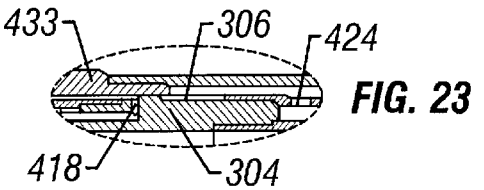
FIGS. 23–24 illustrate transitions of seals as a service tool in the tool assembly of FIG. 2B is raised.
Figure 20E:
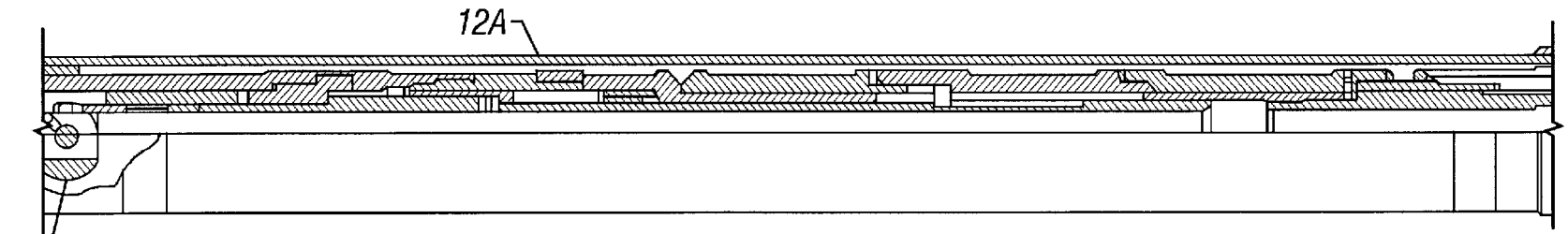
Figure 19D:
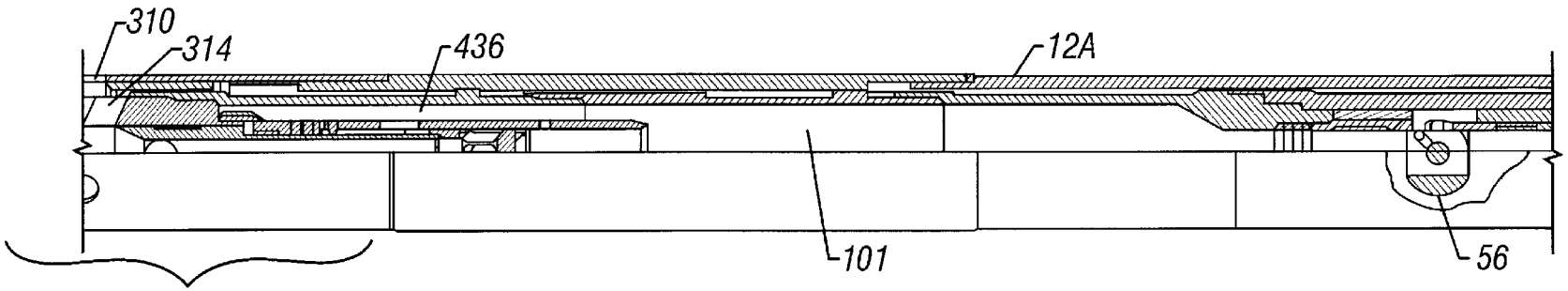
Figure 24:
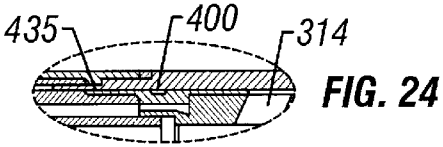
Figure 20F:
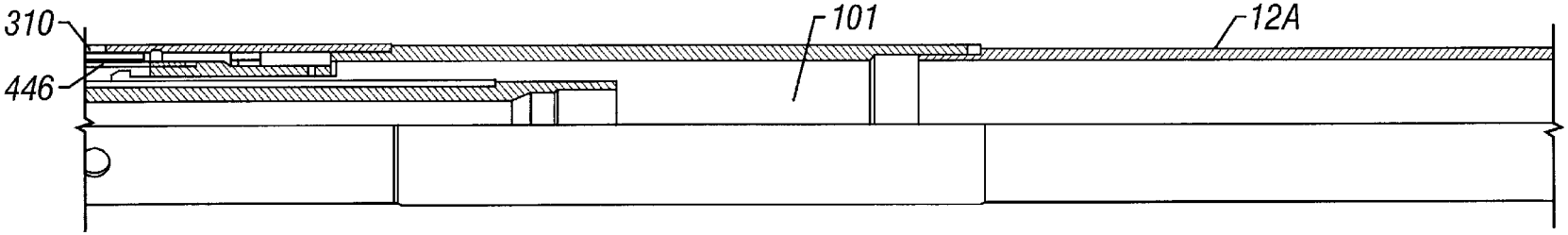
Figure 19E:
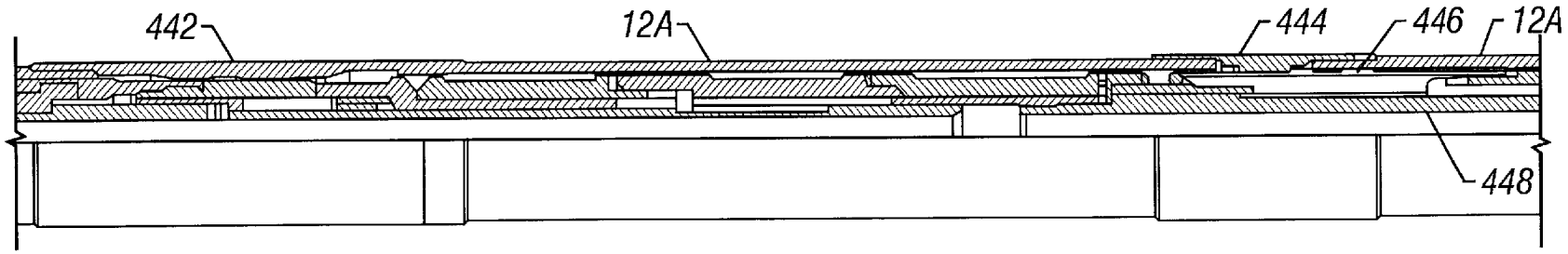
Figure 20G:
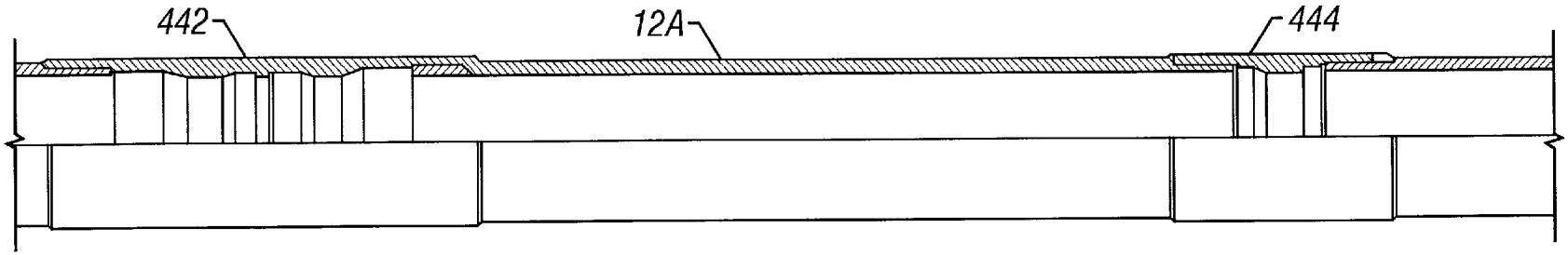
Figure 19F:
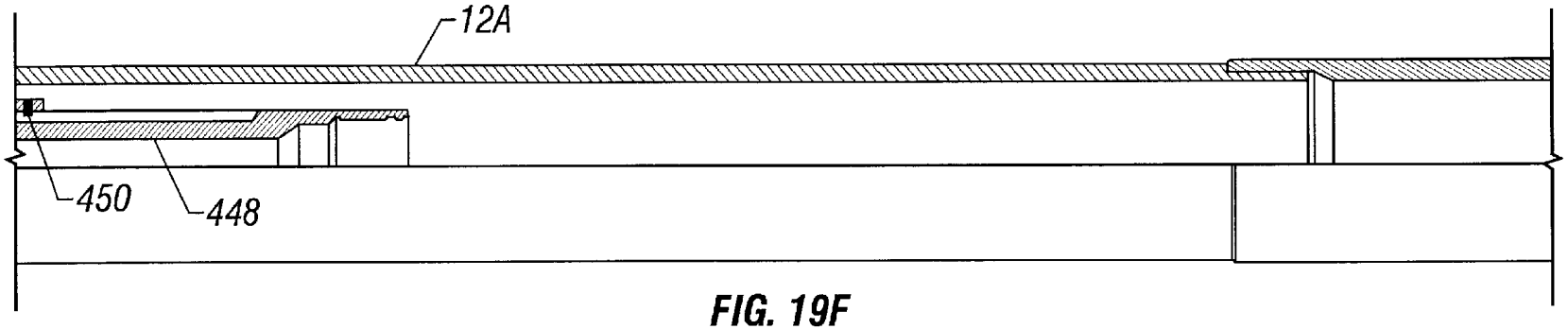
Figure 20H:
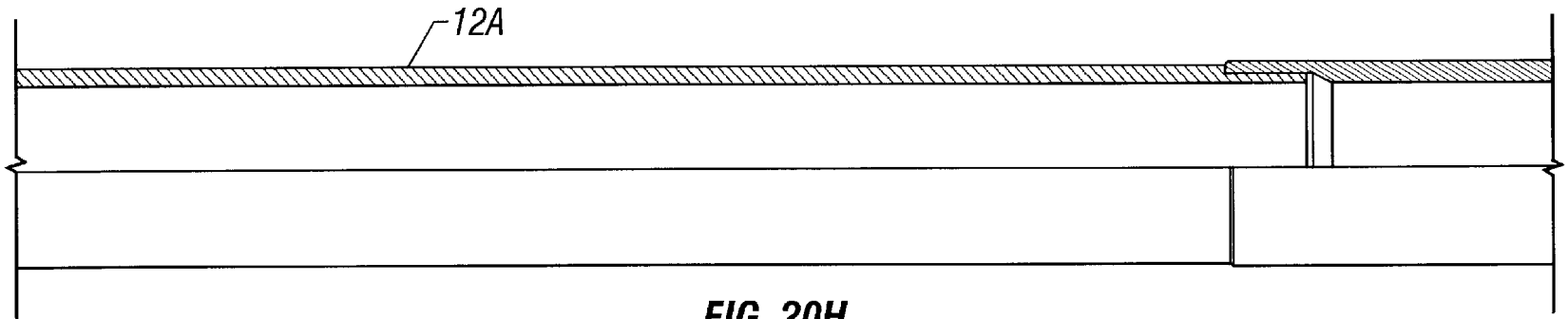
Figure 20A:
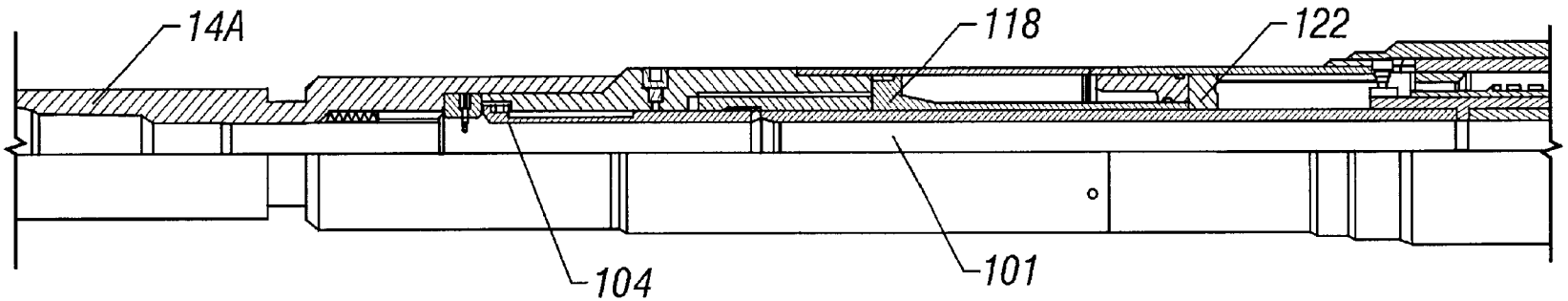
Figure 20B:
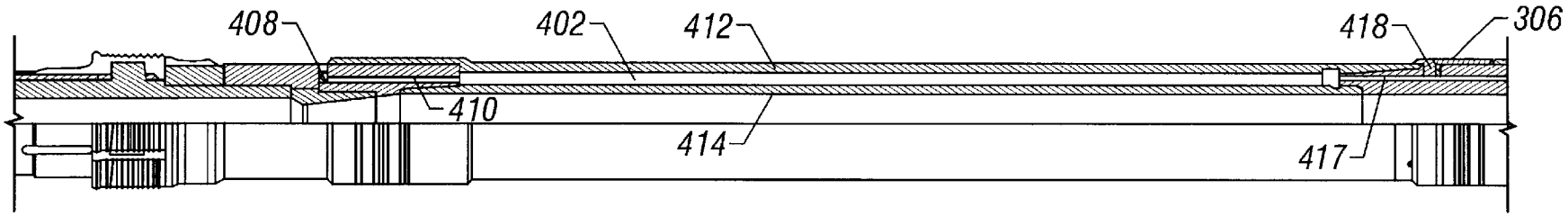
Figure 22B:
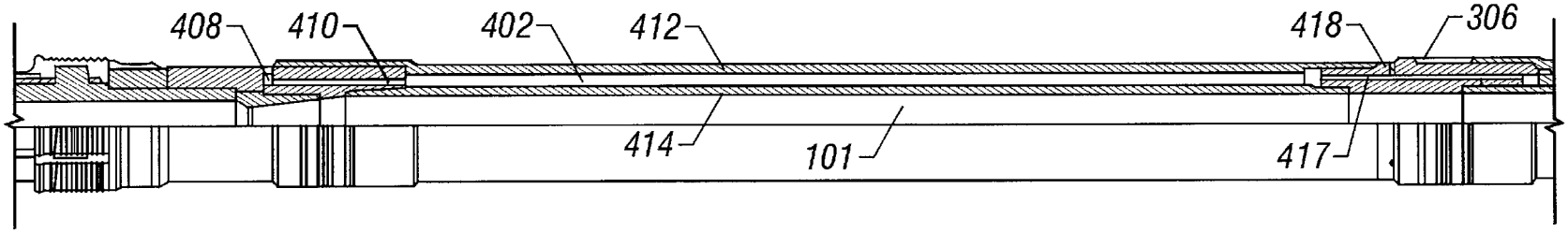
Figure 22C:
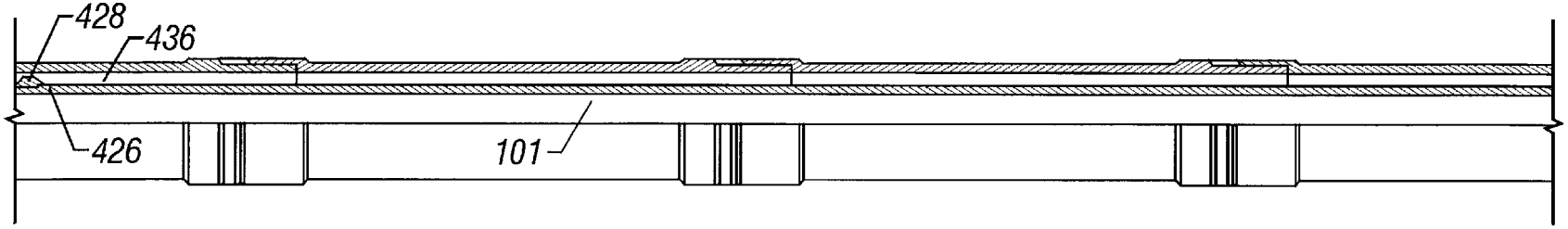

In FIG. 23, the seal 306 has just started engagement with the inside of the housing section 433. However, right before engagement of the seal 306 with the housing section 433, an outer seal 435 of the service tool 14A (FIG. 18D) that was engaged in the seal bore receptacle 400 disengages from the seal bore receptacle 400, as shown in FIG. 24. This opens fluid communication between the cross-over ports 314 and the ports 310.

Figure 19A:
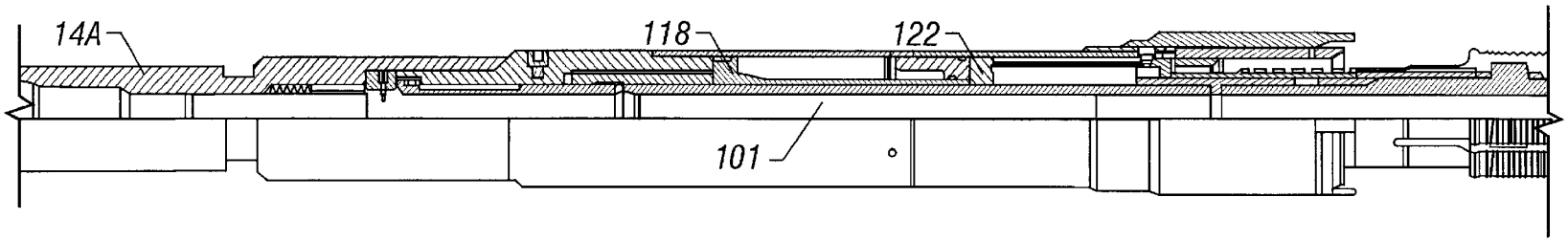
Figure 19B:
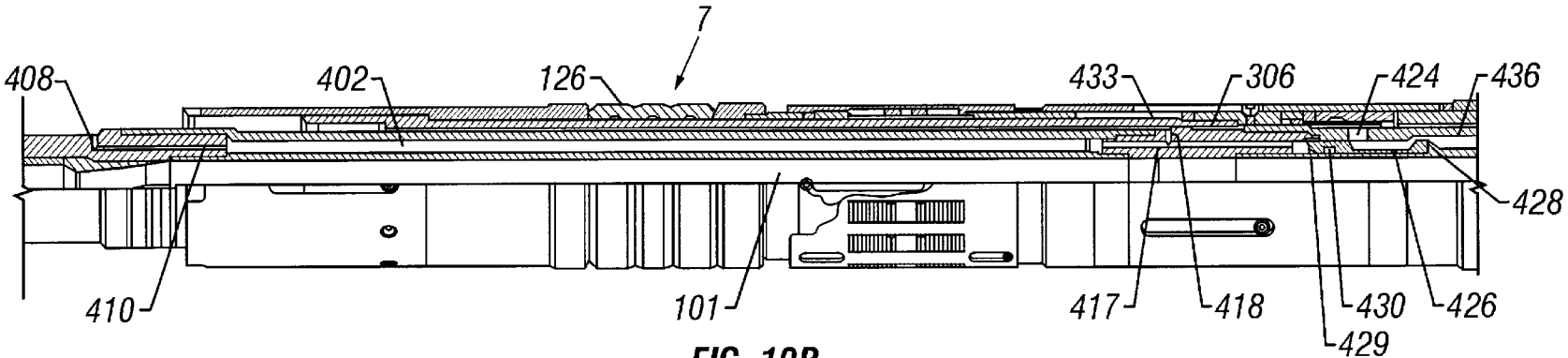
Figure 20D:
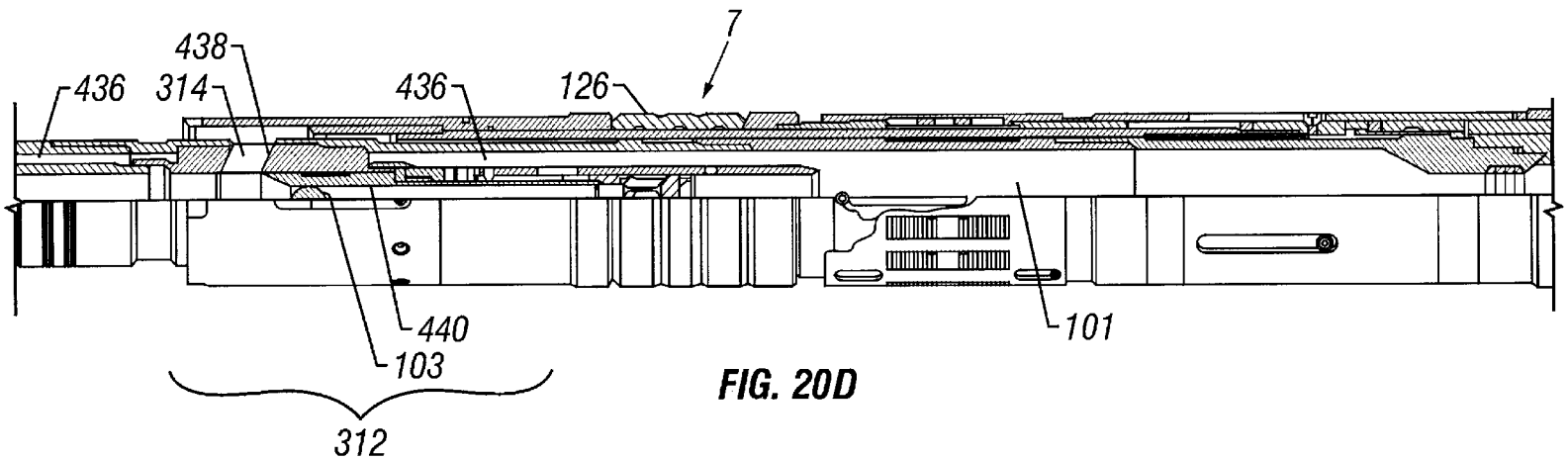
Figure 19C:
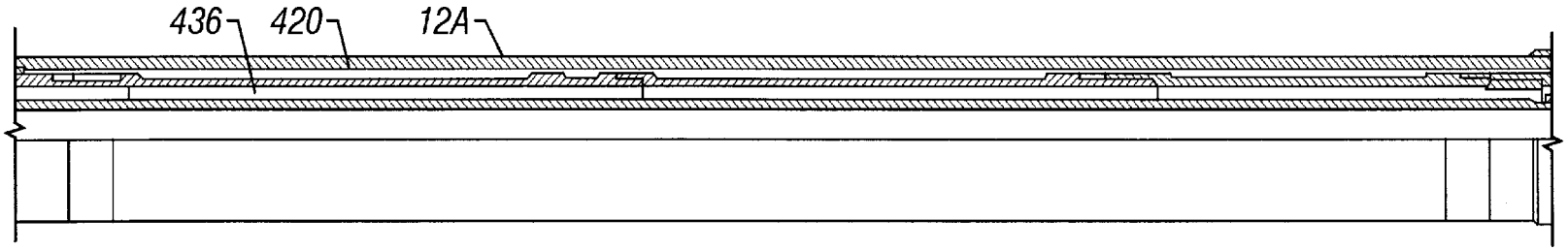

The increase in applied pressure in the annular region 17 during the pressure test also causes opening of the return port valve 422. As shown in FIG. 19B, the pressure in the annular region 17 is communicated through the port 408 and conduit 410 to the conduit 402. In turn, the pressure is communicated through the conduit 417 to one side of the sleeve member 426. The other side of the sleeve member 426 is in communication with the hydrostatic pressure that exists below the ball 103 inside the inner bore 101 of the service tool 14A. Thus, if the applied differential pressure is large enough, the shear element 430 is broken to cause the sleeve member 426 to move downwardly. As a result, the protruding portion 428 of the sleeve member 426 is no longer engaged to the inner wall of the service tool housing 432. This enables communication between the port 424 and the conduit 436.

After the packer 7 has been pressure tested, the service tool 14A is raised even further to its reverse position (FIGS. 20A–20H). The service tool 14A is raised until the cross-over ports 314 are above the packer 7. Acid may be pumped down the tubing string 8 to perform a pickle operation. Fluid can then be pumped down the annular region 17 to wash the acid out of the tubing string 8. The fluid flows down the annular region 17, through the cross-over ports 314, and up the tubing string 8.

In the position shown in FIGS. 20A–20H, the elevated pressure in the target open hole section is maintained by communicating the pressure in the annular region 17 through the port 424 and the open return port valve 422. The pressure is communicated through the return port valve 422 down the conduit 436, which leads to the inner bore 101 of the service tool 14A. The ball valve 56 is open, so that the pressure is communicated through the open ball valve 56 and down the rest of the tool assembly 10A to the target open hole section.

Next, the service tool 14A is slacked off and set-down back into the housing 12A. A sufficient set-down force is applied so that the shear element 450 (FIG. 21F) is sheared to release the set-down collet 446 from the sleeve 448. The position of the tool assembly 10A shown in FIGS. 21A–21G corresponds to the circulate position, in which gravel slurry is pumped down the tubing string 8 and into the inner bore 101 of the service tool 14A. The gravel slurry flows through the cross-over ports 314 into the conduit 420. The gravel slurry then flows out the ports 310 into the annular region 9 around the tool assembly 10A.

Figure 21A:
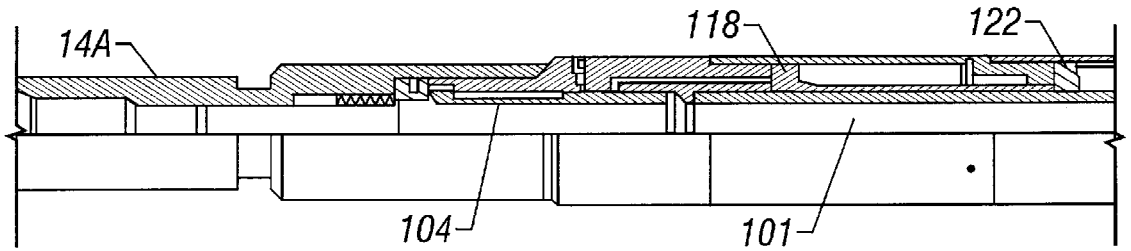
Figure 21B:
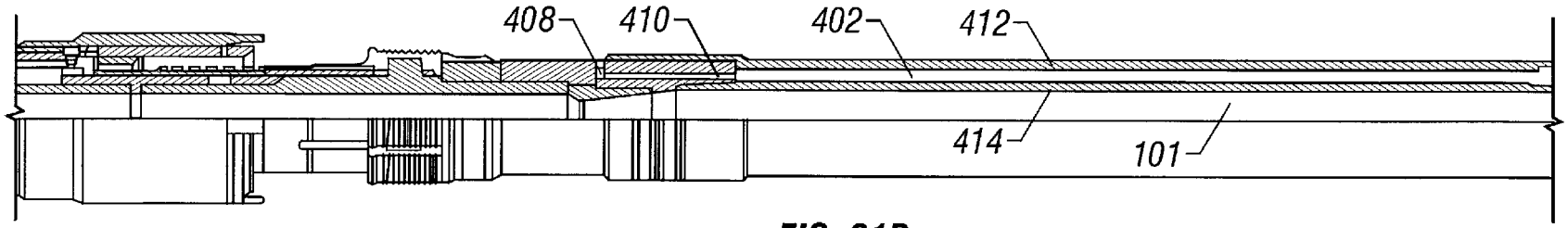
Figure 21C:
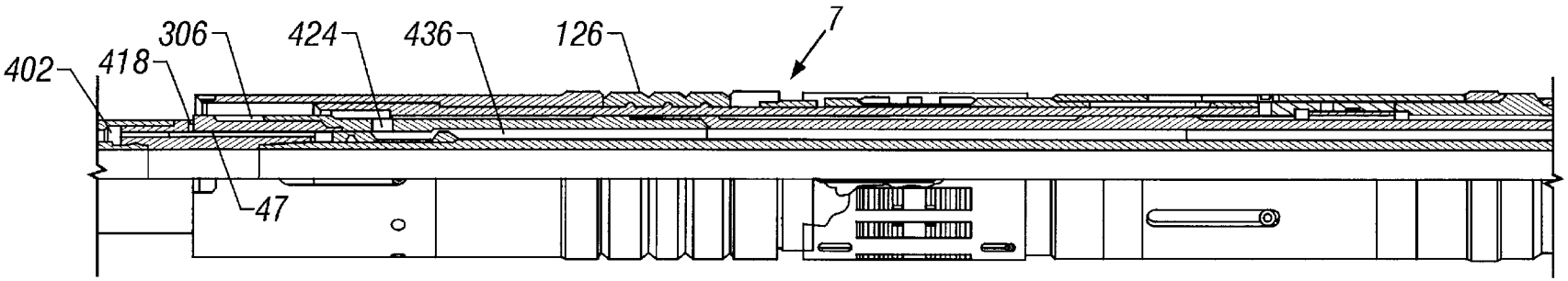
Figure 22D:
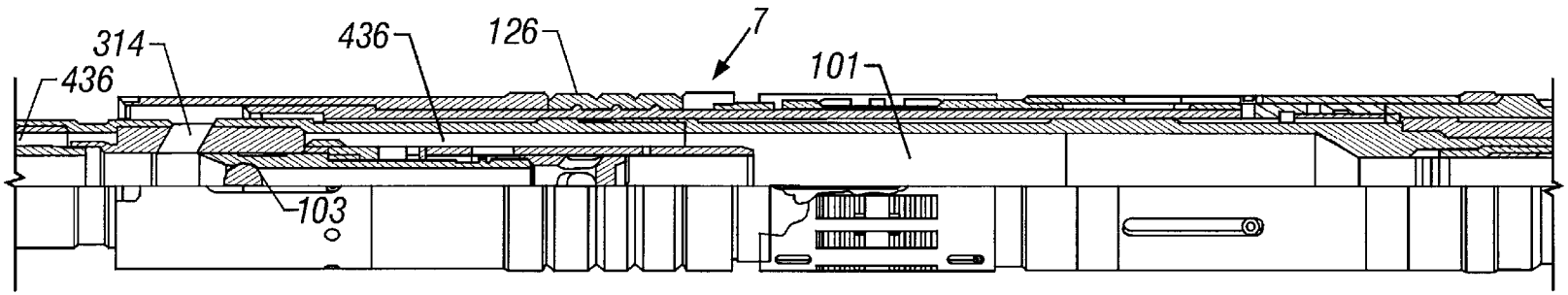
Figure 21D:
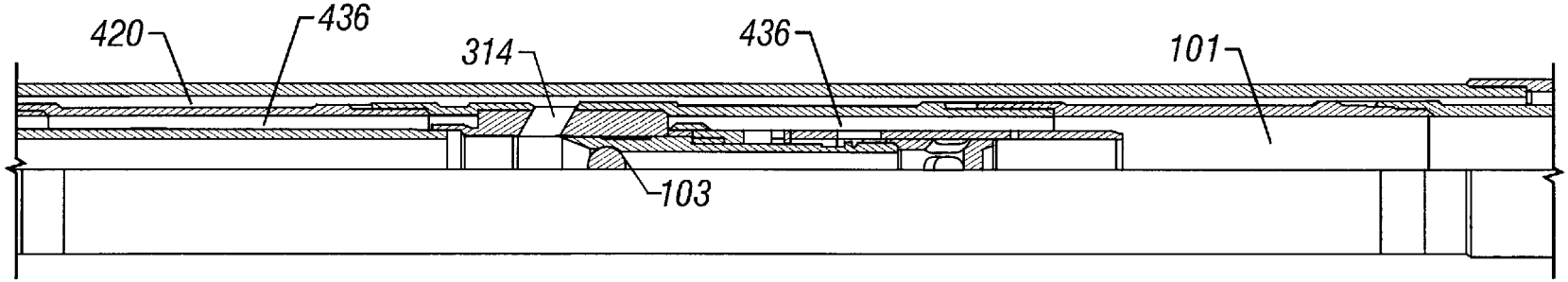
Figure 22E:
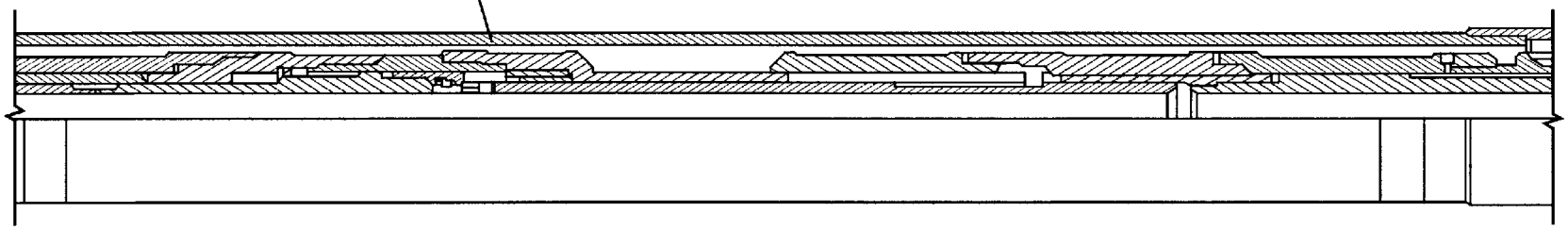
Figure 21E:
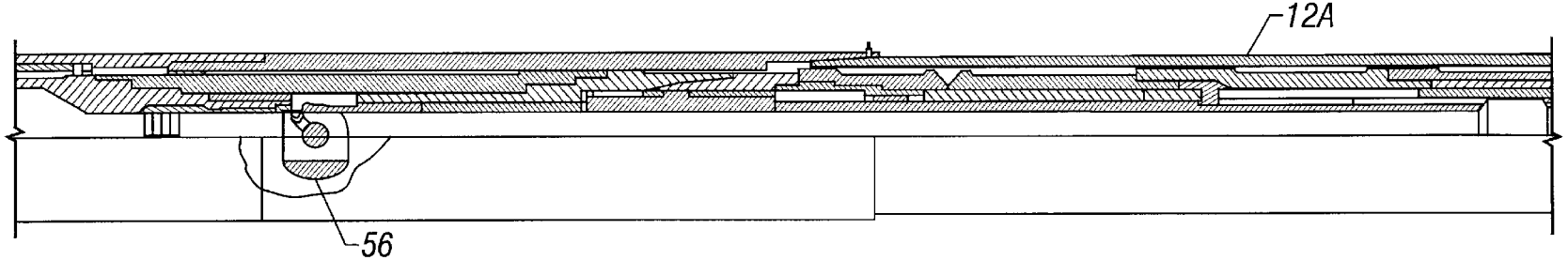
Figure 22F:
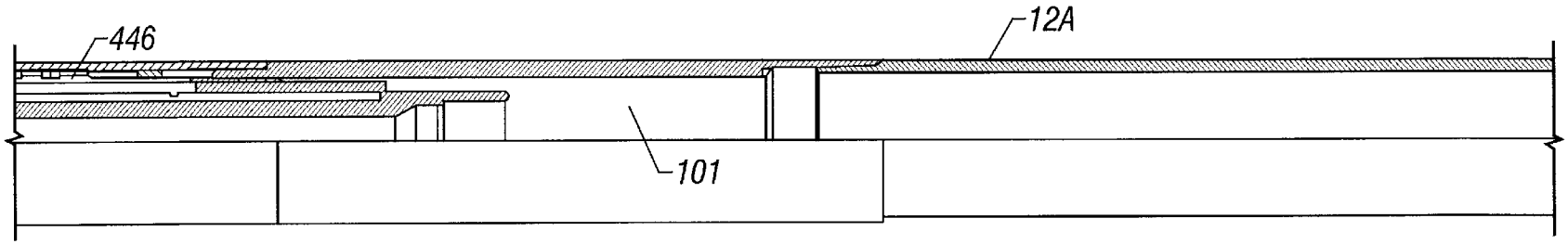
Figure 21F:
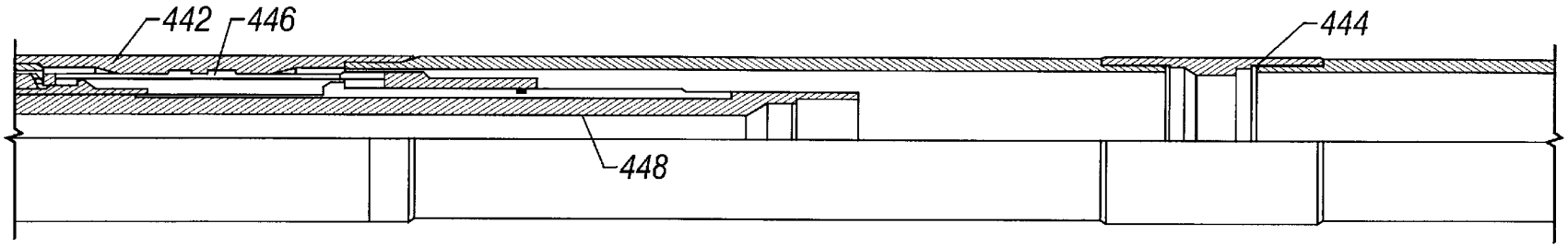
Figure 22G:
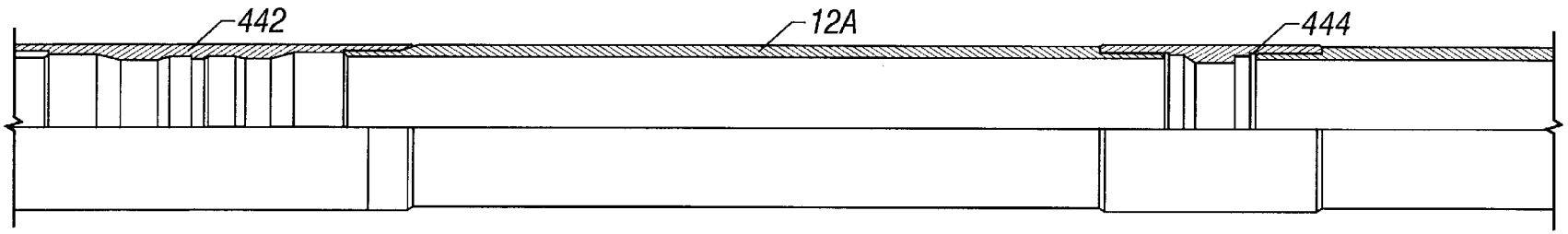
Figure 21G:
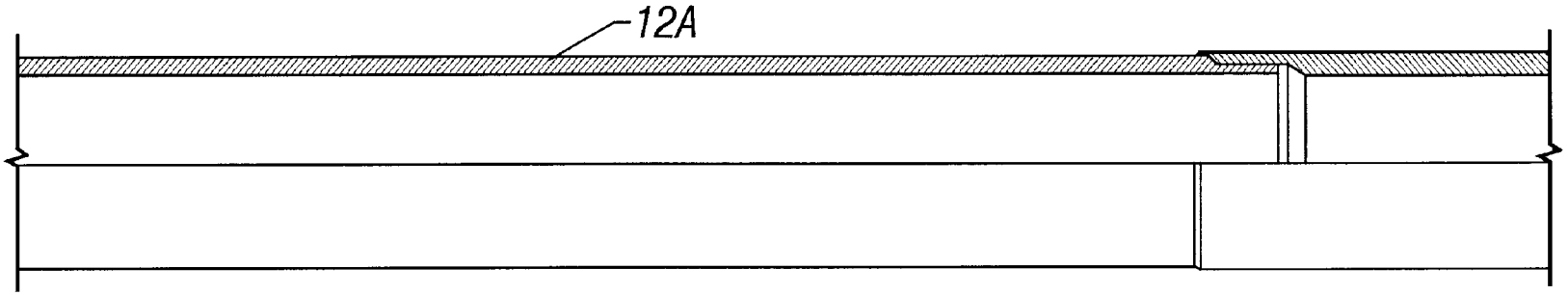
Figure 22H:
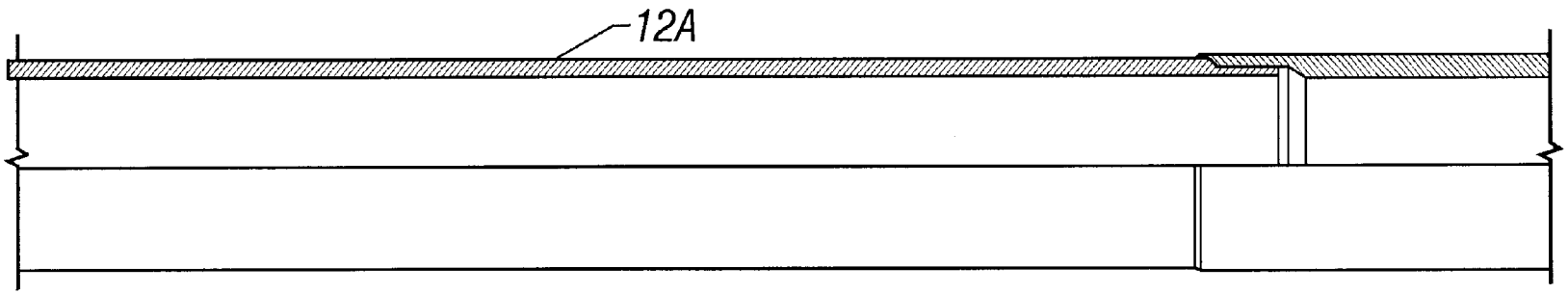
Figure 22A:
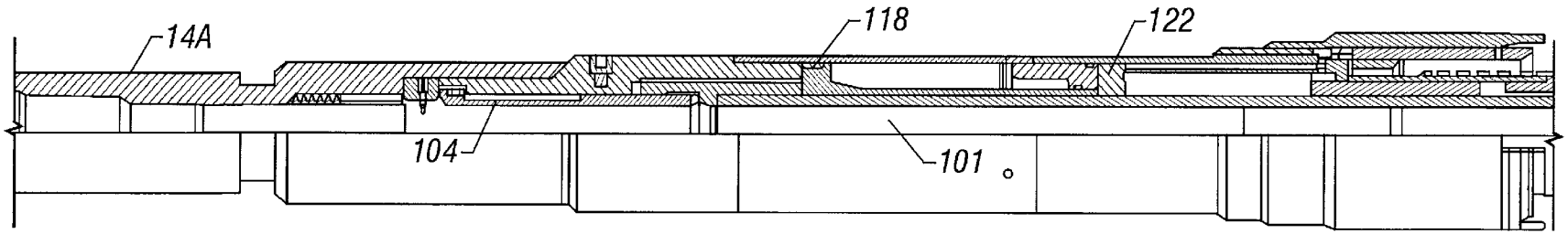

The workover fluid is returned through the bottom end of the tool assembly 10A, and up into the inner bores of the housing 12A and service tool 14A. The workover fluid flows through the open ball valve 56 and into the conduit 436. As shown in FIG. 21C, the return flow valve 422 is in its open position so that the workover fluid can be communicated through the port 424 and up through the annular region 17.

After the annular region 9 has been filled with gravel material, the service tool 14A is again raised to its reverse position, where the cross-over ports 314 are raised above the packer 7. The service tool 14A is then lifted to its reverse position, as shown in FIGS. 22A–22H. When the set down collet 446 engages the inner profile of the set down collar 442, the set down collet 446 is engaged while the service tool 14A continues to be raised. As a result, the ball valve operating mechanism is actuated to close the ball valve. Reversing fluid is then pumped down the annular region 17 to reverse gravel slurry out of the tubing string 8.

While the invention has been disclosed with respect to a limited number of embodiments, those skilled in the art will appreciate numerous modifications and variations therefrom. It is intended that the appended claims cover all such modifications and variations as fall within the true spirit and scope of the invention.

What is claimed is:

1. A method for use in a wellbore, comprising:

performing a gravel pack operation with a tool assembly in a section of the wellbore, the tool assembly attached to a tool string;

providing a bypass mechanism in the tool assembly;

actuating the bypass mechanism between at least a first position and a second position using a remote signal;

maintaining communication of an elevated pressure through the bypass mechanism to the wellbore section to provide an overbalance condition in the wellbore section, the bypass mechanism communicating pressure from inside the tool string to the wellbore section if the bypass mechanism is in the first position, and the bypass mechanism communicating pressure from an annular region outside the tool string to the wellbore section if the bypass mechanism is in the second position; and initially setting the bypass mechanism to the second position prior to performing the gravel pack operation.

2. The method of claim 1, wherein performing the gravel pack operation with the tool assembly comprises actuating a sealing element against the wellbore, and wherein maintaining communication of the elevated pressure comprises communicating the elevated pressure past the sealing element with the bypass mechanism.

3. The method of claim 1, wherein actuating the bypass mechanism using the remote signal comprises actuating the bypass mechanism using applied pressure.

4. The method of claim 1, wherein providing the bypass mechanism comprises providing a bypass valve having plural positions.

5. The method of claim 1, further comprising providing a bore through the tool assembly, and providing a valve to control flow through the bore.

6. The method of claim 5, wherein providing the valve comprises providing a ball valve.

7. The method of claim 5, further comprising actuating the valve to a first position to allow flow through the bore and to a second position to block flow through the bore.

8. The method of claim 7, further comprising locking the valve in the first position and applying a predetermined force to the tool assembly to unlock the valve.

9. The method of claim 8, wherein applying the predetermined force comprises applying a set-down force.

10. The method of claim 8, wherein locking the valve is performed during at least run-in and packer test operations.

11. The method of claim 10, wherein unlocking the valve is performed to enable the valve to be closed during a reverse circulate operation.

12. The method of claim 1, further comprising:

setting the bypass mechanism to the first position; and after setting the bypass mechanism to the first position, pressure testing the packer in the tool assembly by applying an elevated pressure to the annular region.

13. The method of claim 12, wherein setting the bypass mechanism to the first position is performed after initially setting the bypass mechanism to the second position, the method further comprising:

after setting the bypass mechanism to the first position, setting the bypass mechanism back to the second position; and performing the gravel pack operation with the bypass mechanism in the second position.

14. A method for use in a wellbore, comprising:

performing a gravel pack operation with a tool assembly in a section of the wellbore;

actuating a bypass mechanism in the tool assembly between plural positions during phases of the gravel pack operation;

maintaining communication of an elevated pressure through the bypass mechanism to the wellbore section to provide an overbalance condition in the wellbore section, the elevated pressure communicated through different paths in the tool assembly corresponding to the plural positions of the bypass mechanism, wherein actuating the bypass mechanism comprises actuating the bypass mechanism using applied fluid pressure; and providing a flow control device to control flow through an inner bore of the tool assembly.

15. The method of claim 14, wherein performing the gravel pack operation comprises actuating a sealing element against an inner surface of the wellbore, wherein maintaining communication of the elevated pressure comprises maintaining communication of the elevated pressure past the actuated sealing element.

16. The method of claim 15, further comprising providing at least a portion of the bypass mechanism inside a device on which the sealing element is mounted.

17. The method of claim 15 further comprising providing a service tool having the bypass mechanism through a device on which the sealing element is mounted.

18. The method of claim 14 further comprising maintaining the flow control device in an open position to enable fluid flow through the inner bore of the service tool until after a circulate phase of the gravel pack operation is completed.

19. The method of claim 18, further comprising locking the flow control device in the open position.

20. The method of claim 19, further comprising lifting and setting down the service tool to unlock the flow control device.

21. The method of claim 14, further comprising providing a return flow path through the tool assembly, wherein providing the bypass mechanism comprises providing the bypass mechanism having a valve to control fluid flow through the return path.

22. The method of claim 21, further comprising maintaining the valve closed during run-in of the tool assembly to direct washdown fluid to the lower end of a service string comprising the tool assembly and to prevent flow of the washdown fluid up the return path.

23. The method of claim 21, further comprising actuating the valve open to enable communication of the elevated pressure to the wellbore section.

24. The method of claim 14, wherein maintaining communication of the elevated pressure comprises:

maintaining communication of the elevated pressure from an annular region outside a tool string if the bypass mechanism is in a first position, maintaining communication of the elevated pressure from inside the tool string if the bypass mechanism is in a second position.

25. The method of claim 14, wherein actuating the bypass mechanism comprises actuating a bypass valve having at least a first position and a second position.

26. The method of claim 25, wherein performing the gravel pack operation comprises setting a packer in the tool assembly, testing the packer, performing a circulate operation, and performing a reverse operation, wherein actuating the bypass valve comprises actuating the bypass valve to the second position for testing the packer and actuating the bypass valve to the first position for setting the packer, performing the circulate operation, and performing the reverse operation.

27. The method of claim 26, wherein the tool assembly comprises a service tool having the bypass valve, and wherein performing the circulate operation comprises:

lifting the service tool and subsequently setting the service tool down; and pumping gravel slurry through the service tool and out of a port of the tool assembly.

28. The method of claim 14, wherein providing the flow control device comprises providing a ball valve.

29. A gravel pack apparatus attachable to a tool string, comprising:

a tool assembly comprising a sealing element and a bypass mechanism, the bypass mechanism adapted to communicate an elevated pressure past the sealing element to a target wellbore section to maintain an overbalance condition in the target wellbore section, the bypass mechanism having an actuator that is adapted to be remotely actuatable by a remote signal between at least a first position and a second position, the bypass mechanism if in the first position adapted to communicate pressure from outside the tool string to the target wellbore section, and the bypass mechanism if in the second position adapted to isolate a region outside the tool string above the sealing element and to communicate pressure from inside the tool string to the target wellbore section.

30. The apparatus of claim 29, wherein the sealing element comprises a packer.

31. The apparatus of claim 29, wherein the bypass mechanism comprises a bypass valve.

32. The apparatus of claim 29, further comprising a flow control element positioned in a bore of the tool assembly to control flow through the bore, the flow control element maintained in an open position to enable maintenance of the elevated pressure through the tool assembly bore to the target wellbore section.

33. The apparatus of claim 29, wherein the flow control element comprises a ball valve.

34. The apparatus of claim 29, wherein the bypass mechanism has plural positions.

35. The apparatus of claim 34, wherein the tool assembly has plural flow paths that are opened in response to corresponding positions of the bypass mechanism.

36. The apparatus of claim 29, wherein the bypass mechanism comprises a pressure-activated mechanism responsive to an applied pressure.

37. A gravel pack apparatus for use in a wellbore, comprising:

a sealing element adapted to seal against the wellbore; and a tool assembly comprising a bypass mechanism having at least first and second positions, the bypass mechanism adapted to communicate elevated pressure to a wellbore section past the sealing element to provide an overbalance condition in the wellbore section, the bypass mechanism in the first position to communicate elevated pressure from an annular region outside the tool assembly to the wellbore section, the bypass mechanism in the second position to communicate elevated pressure from inside the tool assembly to the wellbore section, the bypass mechanism having a remotely-operable actuator that is adapted to be operated without user manipulation of the tool assembly to move the bypass mechanism between the at least first and second positions.

38. The gravel pack apparatus of claim 37, wherein the tool assembly has a first flow path and a second flow path, the bypass mechanism adapted to enable fluid communication in the first flow path if the bypass mechanism is in the first position, and the bypass mechanism adapted to enable fluid communication in the second flow path if the bypass mechanism is in the second position.

39. The gravel pack apparatus of claim 37, wherein the tool assembly comprises an inner bore and a flow control element adapted to control flow through the inner bore, the flow control element in an open position cooperable with the bypass mechanism to communicate the elevated pressure to the wellbore section.

40. The gravel pack apparatus of claim 39, wherein the flow control element comprises a ball valve.

41. The gravel pack apparatus of claim 39, wherein the flow control element is adapted to be locked open by a shear element.

42. The gravel pack apparatus of claim 41, wherein the service tool is adapted to be lifted and set down to break the shear element.

43. The gravel pack apparatus of claim 37, wherein the bypass mechanism comprises a bypass valve.

* * * * *